US011117389B2

(12) United States Patent
Harada et al.

(10) Patent No.: US 11,117,389 B2
(45) Date of Patent: Sep. 14, 2021

(54) HANDHELD RECORDING DEVICE

(71) Applicants: Yasunari Harada, Kanagawa (JP); Tetsuyoshi Nakata, Kanagawa (JP); Hideaki Iijima, Kanagawa (JP)

(72) Inventors: Yasunari Harada, Kanagawa (JP); Tetsuyoshi Nakata, Kanagawa (JP); Hideaki Iijima, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/540,244

(22) Filed: Aug. 14, 2019

(65) Prior Publication Data

US 2020/0079113 A1 Mar. 12, 2020

(30) Foreign Application Priority Data

Sep. 10, 2018 (JP) ..... JP2018-168914
Nov. 13, 2018 (JP) ..... JP2018-213335

(51) Int. Cl.
*B41J 3/36* (2006.01)

(52) U.S. Cl.
CPC ..... *B41J 3/36* (2013.01)

(58) Field of Classification Search
CPC ..... B41J 3/36; B41J 3/39
See application file for complete search history.

(56) References Cited

U.S. PATENT DOCUMENTS

2006/0192804 A1 8/2006 Nakata et al.
2009/0028586 A1 1/2009 Yamashiro et al.
2009/0237744 A1 9/2009 Ogura et al.
2012/0113180 A1 5/2012 Tanaka et al.
2012/0113204 A1 5/2012 Tanaka et al.
2012/0133693 A1 5/2012 Iijima
2014/0253620 A1 9/2014 Watanabe et al.
2014/0268388 A1 9/2014 Shuta et al.
2016/0082719 A1 3/2016 Harada et al.
2016/0107467 A1 4/2016 Nakata et al.
2018/0250947 A1 9/2018 Nakata et al.
2018/0250948 A1 9/2018 Harada et al.
2018/0354257 A1 12/2018 Watanabe et al.
2019/0105920 A1 4/2019 Hosokawa et al.
2019/0143674 A1 5/2019 Iijima et al.
2020/0084333 A1* 3/2020 Fujii ..... B41J 29/13

FOREIGN PATENT DOCUMENTS

JP 11-058850 3/1999

* cited by examiner

*Primary Examiner* — Kristal Feggins
(74) *Attorney, Agent, or Firm* — Harness, Dickey & Pierce, P.L.C.

(57) ABSTRACT

A handheld recording device includes a first face, a second face, a third face pair, a recorder, and a connector. The first face has an opening. The second face is disposed opposite the first face. The third face pair is different from the first face and the second face. One of the third face pair is disposed on one side in a given direction of the second face and configured to be held by a user for recording. The recorder is configured to discharge ink from the opening. The connector is configured to be connected to a cable to receive at least one of power and image data. The connector is disposed at a position closer to the second face than the first face, on another one of the third face pair disposed on another side in the given direction of the second face.

12 Claims, 13 Drawing Sheets

HANDHELD RECORDING DEVICE

CROSS-REFERENCE TO RELATED APPLICATIONS

This patent application is based on and claims priority pursuant to 35 U.S.C. § 119(a) to Japanese Patent Application Nos. 2018-168914, filed on Sep. 10, 2018, and 2018-213335, filed on Nov. 13, 2018, in the Japan Patent Office, the entire disclosure of each of which is hereby incorporated by reference herein.

BACKGROUND

Technical Field

Embodiments of the present disclosure relate to a handheld recording device.

Related Art

In recent years, with the downsizing of notebook computers and the rapid spread of smart devices represented by smartphones, downsizing and portability have been demanded for printers. There is known a handheld printer that applies ink while being manually operated to scan on a print medium, such as paper, without a recording medium conveyance system (e.g., paper conveyance system). In response to image data from a data output device such as a smart device (e.g., smartphone) or a computer (e.g., personal computer), the handheld printer scans flat and freely (freehand) on a print medium (e.g., notebook or standard paper) to form (or record) an image.

The handheld printer may receive the image data transmitted from the data output device via wireless communication. Alternatively, the handheld printer may receive the image data via wired communication. For example, a universal serial bus (USB) cable is connected to the handheld printer for the purpose of charging a battery for driving the handheld printer, in addition to the purpose of transmission of the image data.

SUMMARY

In one embodiment of the present disclosure, a novel handheld recording device includes a first face, a second face, a third face pair, a recorder, and a connector. The first face has an opening. The second face is disposed opposite the first face. The third face pair is different from the first face and the second face. One of the third face pair is disposed on one side in a given direction of the second face and configured to be held by a user for recording. The recorder is configured to discharge ink from the opening. The connector is configured to be connected to a cable to receive at least one of power and image data. The connector is disposed at a position closer to the second face than the first face, on another one of the third face pair disposed on another side in the given direction of the second face.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1A:
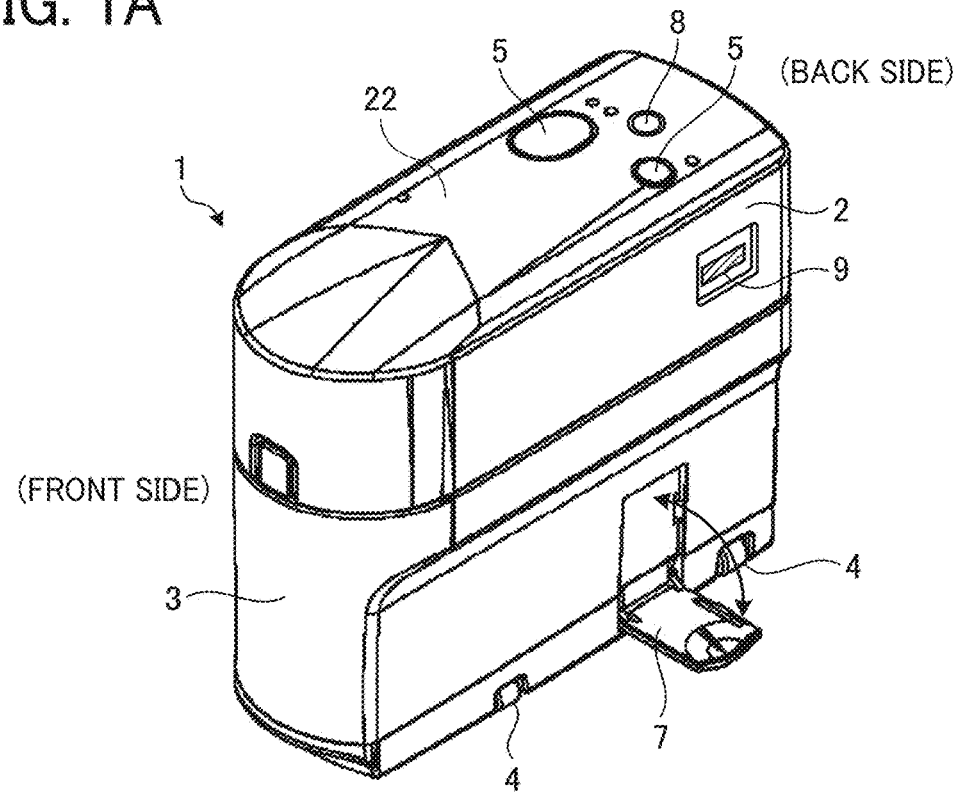
FIG. 1A is an external perspective view of a handheld printer according to a first embodiment of the present disclosure.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

Referring to the drawings, wherein like reference numerals designate identical or corresponding parts throughout the several views, embodiments of the present disclosure are described below.

Initially, a description is given of a first embodiment of the present disclosure.

Figure 1B:
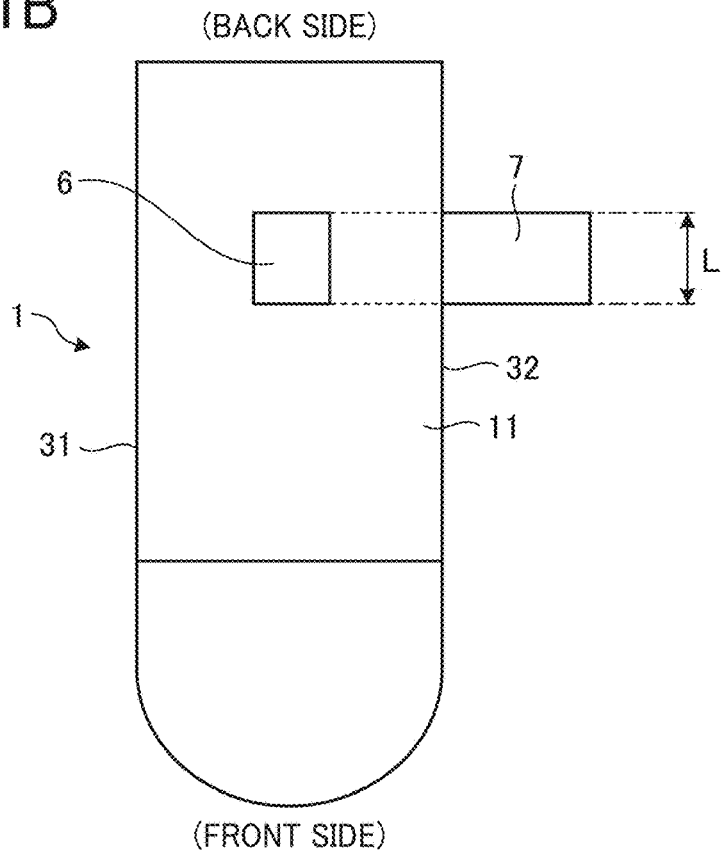
FIG. 1B is a bottom view of the handheld printer according to the first embodiment.

Referring now to FIGS. 1A and 1B, a description is given of an external configuration of a handheld printer 1 according to the first embodiment.

FIG. 1A is an external perspective view of the handheld printer 1 according to the first embodiment. FIG. 1B is a bottom view of the handheld printer 1 according to the first embodiment.

As illustrated in FIG. 1A, the handheld printer 1, serving as a handheld recording device, includes an upper unit 2 and a lower unit 3. Note that "front side" and "back side" refer to a user side and an opposite side, respectively, when a user holds the handheld printer 1. "Right side face" and "left side face" refer to a side face on user's right and a side face on user's left, respectively, when the user holds the handheld printer 1. Among the faces of a main body of the handheld printer 1, a "lower face" refers to a face that faces a print medium and has an opening (e.g., opening 6 described later). An "upper face" refers to a face opposite the "lower face". The handheld printer 1 may print on a print medium placed horizontally. Alternatively, the handheld printer 1 may print on a print medium disposed on, e.g., a vertical wall. In this case, the expressions "side face", "lower face", and "upper face" are not necessarily substantial. For the sake of simplicity, however, the expressions "side face", "lower face", and "upper face" are herein used provided that the print medium is placed horizontally. The same applies to the other embodiments. According to the embodiments of the present disclosure, a lower face 11 serves as a first face. An upper face 22 serves as a second face. A left side face 31 and a right side face 32 serve as third faces. A back side face 41 serves as a fourth face. A front side face 51 serves as a fifth face. Occasionally, the left side face 31, the right side face 32, the back side face 42, and the front side face 51 may serve as third faces when collectively regarded as side faces.

The upper unit 2 has a control board mounted inside. On the upper face 22, the upper unit 2 includes operation buttons 5 and a light emitting diode (LED) 8. A user, for example, performs various operations with the operation buttons 5. The LED 8 displays, e.g., an operation status of the handheld printer 1. A universal serial bus (USB) connector 9 (also referred to as a USB port) is disposed in the upper unit 2, on the back side of the right side face 32 of the handheld printer 1, to be connected to a USB cable 151. Note that FIG. 1A illustrates the USB connector 9 having a longitudinal shape in a horizontal direction. Alternatively, the USB connector 9 may have a longitudinal shape in a vertical direction, which is perpendicular to the horizontal direction, to reduce the load on the USB connector 9 due to the load of the USB cable 151 connected to the USB connector 9. A detailed description of the USB cable 151 is deferred. Note that the location of the USB connector 9 illustrated in FIG. 1A is merely an example. A detailed description of the location of the USB connector 9 is deferred.

The user uses the operation buttons 5 for, e.g., general printing or a normal print operation. The LED 8 is a light emitting element that displays the operation status of the handheld printer 1. For example, the LED 8 displays that the normal print operation is in progress and that the handheld printer 1 is receiving image data.

The lower unit 3 is equipped with a recording head 104 that discharges ink. A detailed description of the recording head 104 is deferred. The lower unit 3 further includes guide rollers 4 and a guide part 7. The guide rollers 4 assist the movement of the main body of the handheld printer 1 in a lateral direction (i.e., scanning direction). The guide part 7 is disposed on one side face, in this case, on the left side face 31.

With the guide part 7, the user ascertains a print area (i.e., an area in which, e.g., an image is printed) on a print medium (e.g., print medium 20 illustrated in FIG. 2) upon printing. FIG. 1A illustrates the guide part 7 released from the side face. The guide part 7 is released as illustrated in FIG. 1A when the user ascertains the print area with the guide part 7. On the other hand, when the user does not use the guide part 7, the user pivots the guide part 7 about a hinge at a lower end of the guide part 7 and stores the guide part 7 in the left side face 31 of the main body of the handheld printer 1.

As illustrated in FIG. 1B, the handheld printer 1 has the opening 6 in the lower unit 3, on the back side of the lower face 11 of the handheld printer 1. That is, the recording head 104 is disposed close to the back side inside the main body of the handheld printer 1. In this case, the "back side" and the "front side" described above may be referred to as a "recording head side" and a "side opposite the recording head side", respectively. For the sake of simplicity, however, the expressions "back side" and "front side" are hereinafter used. The ink discharged from the recording head 104 reaches a print medium, such as a sheet, from the opening 6 to form or record an image. A detailed description of the recording head 104 is deferred. As illustrated in FIG. 1B, the guide part 7 is located on the extension in the scanning direction of the opening 6. A width L of the guide part 7 in a longitudinal direction of the handheld printer 1 is substantially the same as a width of the opening 6 in the longitudinal direction of the handheld printer 1. Thus, when moving the handheld printer 1 in the scanning direction (i.e. short direction of the handheld printer 1) while printing, the user ascertains the print area based on the position of the guide part 7 as an indicator. Note that the guide part 7 may be, e.g., transparent in color. The guide part 7 transparent in color allows the user to ascertain a printing state on the print medium under the released guide part 7 during the print operation.

Figure 2:
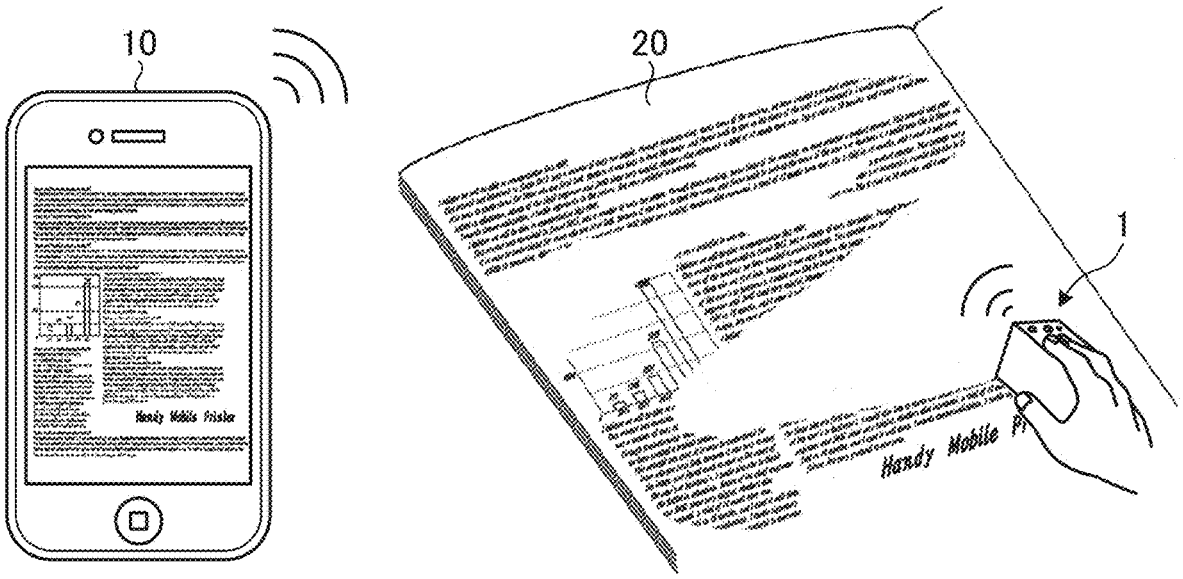
FIG. 2 is a diagram illustrating how the handheld printer scans and prints on a print medium.

Referring now to FIG. 2, a description is given of freehand, print scanning executed by a user holding the handheld printer 1 according to the present embodiment.

FIG. 2 is a diagram illustrating how the handheld printer 1 scans and prints on a print medium 20.

As illustrated in FIG. 2, the handheld printer 1 firstly receives, from an external device 10, image data to be printed on the print medium 20. In the example of FIG. 2, the handheld printer 1 receives the image data from the external device 10 via wireless communication. Alternatively, however, the handheld printer 1 may receive the image data by wired communication, in connection with the external device 10 via the USB cable 151 connected to the USB connector 9.

The user operates the operation buttons 5 of the handheld printer 1 to determine an initial position on the print medium 20 and start printing. The handheld printer 1 ascertains a print position of the image data, that is, where to print the image data on the print medium 20, based on the initial position thus determined on the print medium 20. The handheld printer 1 has one or more navigation sensors 106 (hereinafter collectively referred to as a navigation sensor 106) such as acceleration sensors or gyro sensors aboard. With the navigation sensor 106, the handheld printer 1 recognizes the posture and position thereof from the initial position. A detailed description of the navigation sensor 106 is deferred. When the user scans freehand with the handheld printer 1 on the print medium 20 as illustrated in FIG. 2, the handheld printer 1 continues calculating the position of each nozzle of the recording head 104, based on the information of the position and posture from the navigation sensor 106. Accordingly, the handheld printer 1 specifies which part of the image data is printed with which nozzle at each position on the print medium 20. In short, the user moves the handheld printer 1 in a free direction to scan freehand on the print medium 20, thereby printing an image on the print medium 20 according to the image data.

Figure 3:
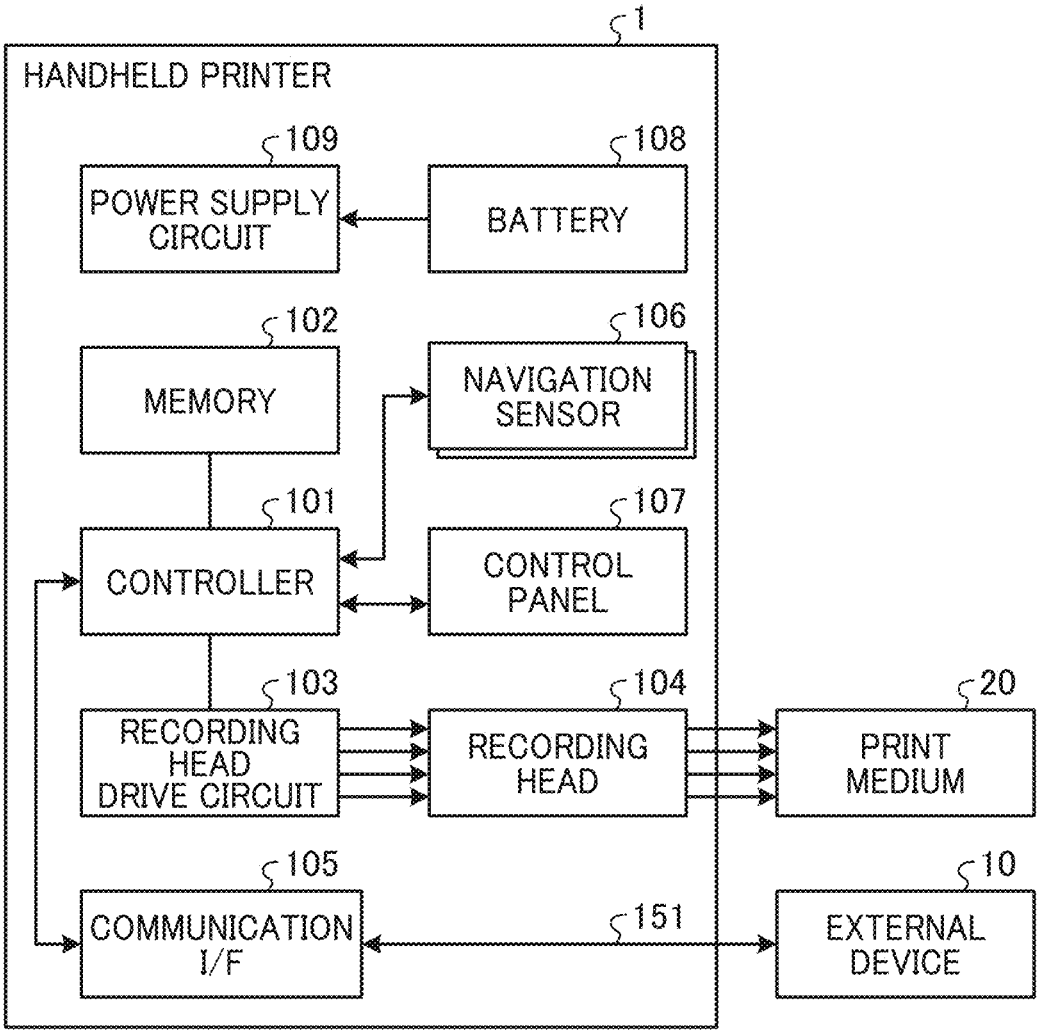
FIG. 3 is a block diagram illustrating a hardware configuration of the handheld printer according to the first embodiment.

Referring now to FIG. 3, a description is given of a hardware configuration of the handheld printer 1 according to the first embodiment.

FIG. 3 is a block diagram illustrating the hardware configuration of the handheld printer 1 according to the first embodiment.

As illustrated in FIG. 3, the handheld printer 1 includes a controller 101, a memory 102, a recording head drive circuit 103, the recording head 104, a communication interface (I/F) 105, the navigation sensor 106, a control panel 107, a battery 108, and a power supply circuit 109. The recording head 104 herein serves as a recorder.

The controller 101 controls an entire operation of the handheld printer 1. The controller 101 is constructed of, e.g., a system on a chip (SoC) and a field-programmable gate array (FPGA). The SoC includes a central processing unit (CPU). Note that the controller 101 may include an application specific integrated circuit (ASIC) instead of or in addition to the FPGA. The controller 101 may include the CPU as a single unit, instead of the CPU included in the SoC. The controller 101 reads and executes an operation program stored in the memory 102, thereby controlling the entire operation of the handheld printer 1.

The memory 102 is a non-volatile storage device that stores, e.g., the operation program, firmware for controlling each device, drive waveform data for driving the recording head 104, and a print job (image data) received from the external device 10. The memory 102 is, e.g., a hard disk drive (HDD), a solid state drive (SSD), or a semiconductor memory such as a flash memory.

The recording head drive circuit 103 drives and controls the recording head 104. According to a drive signal based on the drive waveform data, the recording head drive circuit 103 controls the recording head 104 to discharge ink. The recording head 104 is a device that discharges ink from nozzles by the operation of a piezoelectric element according to the drive signal from the recording head drive circuit 103.

The communication I/F 105 performs data communication with the external device 10. The communication I/F 105 corresponds to the USB connector 9 illustrated in FIG. 1A. The communication I/F 105 is connected to the external device 10 via the USB cable 151. The data communication between the communication I/F 105 and the external device 10 may be wired communication with, e.g., the USB cable 151 that couples the communication I/F 105 and the external device 10. Alternatively, the data communication between the communication I/F 105 and the external device 10 may be wireless communication by, e.g., Bluetooth (registered trademark). Note that, when the communication I/F 105 is an interface for wired communication, the communication I/F 105 is not limited to a USB connection port (e.g., USB connector 9). For example, the communication I/F 105 may be Ethernet (registered trademark) interface or serial communication interface. The communication I/F 105 herein corresponds to the USB connector 9 (i.e., USB port).

The navigation sensor 106 detects the posture and position of the handheld printer 1. Precisely, the navigation sensor 106 detects the posture and position thereof. The navigation sensor 106 is, e.g., a gyro sensor or an acceleration sensor.

The control panel 107 includes, e.g., a button and a display. The user operates the handheld printer 1 with the button. The display displays, e.g., the operation status of the handheld printer 1. The control panel 107 corresponds to the operation buttons 5 and the LED 8 illustrated in FIG. 1A. Note that the control panel 107 may be a liquid crystal touch panel having a touch input function and a display function. The control panel 107 may include an audio output device.

The battery 108 is a rechargeable battery that supplies power to the devices of the handheld printer 1. Note that, when the external device 10 and the communication I/F 105 are connected to each other via the USB cable 151, for example, the battery 108 may be charged with power supplied from the external device 10 via a power supply line included in the USB cable 151.

The power supply circuit 109 converts the power supplied from the battery 108 into power (voltage) for the devices of the handheld printer 1 to supply the power (voltage) to the devices.

Note that the hardware configuration of the handheld printer 1 illustrated in FIG. 3 is merely an example. The handheld printer 1 may include components other than the components illustrated in FIG. 3.

Figure 4:
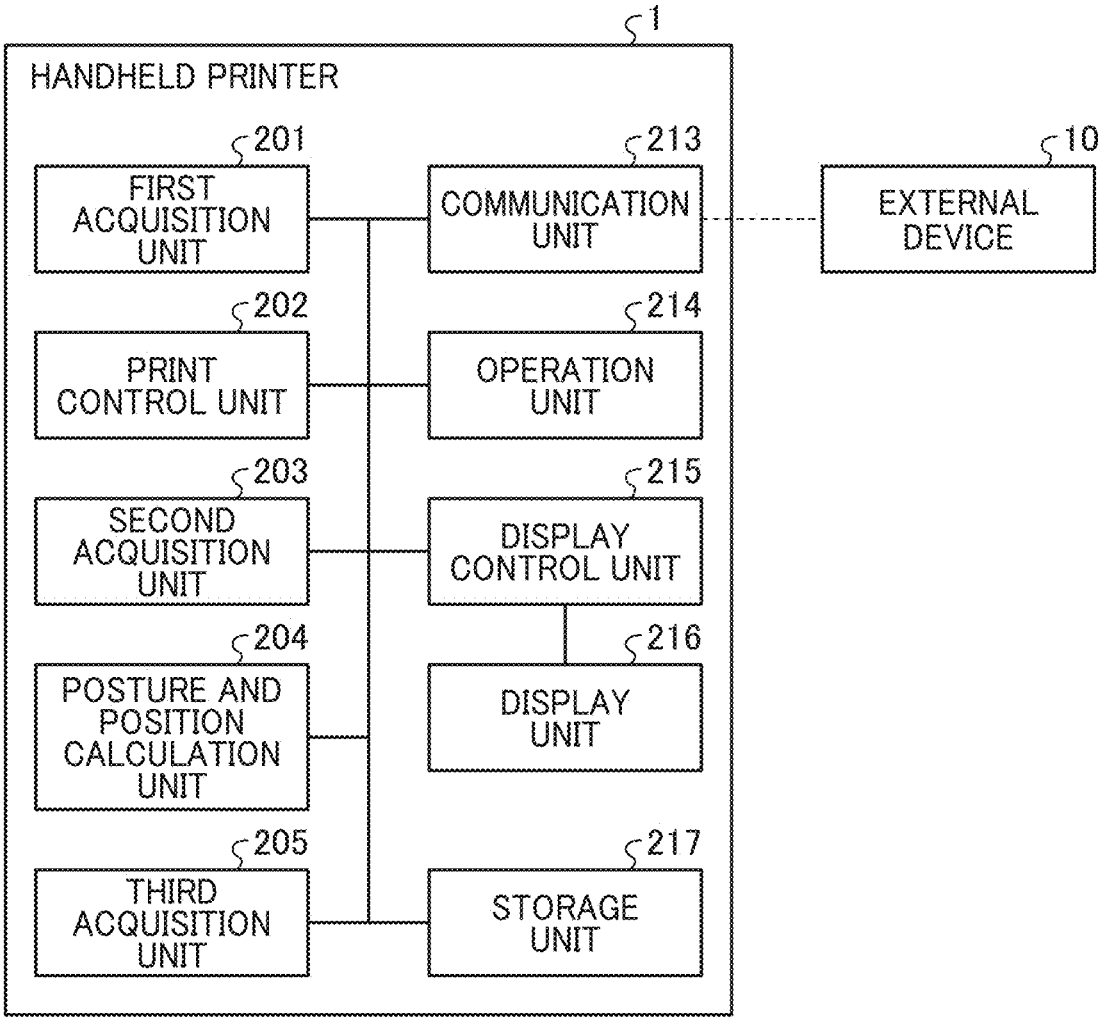
FIG. 4 is a block diagram illustrating a functional configuration of the handheld printer according to the first embodiment.

Referring now to FIG. 4, a description is given of a functional configuration of the handheld printer 1 according to the first embodiment.

FIG. 4 is a block diagram illustrating the functional configuration of the handheld printer 1 according to the first embodiment.

As illustrated in FIG. 4, the handheld printer 1 includes a first acquisition unit 201, a print control unit 202, a second acquisition unit 203, a posture and position calculation unit 204, a third acquisition unit 205, a communication unit 213, an operation unit 214, a display control unit 215, a display unit 216, and a storage unit 217.

The first acquisition unit 201 is a functional unit that acquires a print job (image data) from the external device 10 via the communication unit 213. The first acquisition unit 201 may temporarily stores, in the storage unit 217, the print job acquired from the external device 10 via the communication unit 213 and retrieve the print job from the storage unit 217 for printing.

The print control unit 202 is a functional unit that controls the operation of the recording head drive circuit 103 to cause the recording head 104 to print. In addition, the print control unit 202 transmits a timing signal to the recording head drive circuit 103 to cause the recording head 104 to discharge ink from target nozzles of the recording head 104 onto the print position of the image data to be printed on the print medium 20, when the print position and the positions of the target nozzles of the recording head 104 satisfy given conditions.

The second acquisition unit 203 is a functional unit that acquires the information of the posture and position of the handheld printer 1 (precisely, the navigation sensor 106 itself) detected by the navigation sensor 106. Hereinafter, the information of the posture and position may be simply referred to as posture and position information.

The posture and position calculation unit 204 is a functional unit that calculates the position of each nozzle of the recording head 104 from the posture and position information of the navigation sensor 106 acquired by the second acquisition unit 203. Based on the relative position of the navigation sensor 106 and each nozzle, the posture and position calculation unit 204 calculates the posture and position of each nozzle.

The third acquisition unit 205 is a functional unit that acquires a peripheral image, in the image data, corresponding to the position of each nozzle calculated by the posture and position calculation unit 204.

The communication unit 213 is a functional unit that exchanges data with the external device 10. Specifically, the communication unit 213 receives, e.g., a print job (image data) from the external device 10. On the other hand, the communication unit 213 transmits, to the external device 10, information on the operation status of the general printing, information on the current operation mode, information on the remaining amount of ink in the recording head 104, and information indicating a malfunction of the handheld printer 1. The communication unit 213 is implemented by, e.g., the communication I/F 105 and an operation program executed by the controller 101 illustrated in FIG. 3.

The operation unit 214 is a functional unit that receives an instruction from, e.g., a user. The operation unit 214 is implemented by the control panel 107 (e.g., operation buttons 5) illustrated in FIG. 3.

The display control unit 215 is a functional unit that controls the display operation of the display unit 216.

The display unit 216 is a functional unit that displays, e.g., the operation status of the handheld printer 1 under the control of the display control unit 215. As the operation status of the handheld printer 1, the display unit 216 displays that the normal print operation is in progress and that the handheld printer 1 is receiving image data, for example. The display unit 216 is implemented by the control panel 107 (e.g., LED 8) illustrated in FIG. 3.

The storage unit 217 is a functional unit that stores, e.g., the operation program, the firmware for controlling each device, the drive waveform data for driving the recording head 104, and a print job (image data) received from the external device 10. The storage unit 217 is implemented by the memory 102 illustrated in FIG. 3.

The first acquisition unit 201, the print control unit 202, the second acquisition unit 203, the posture and position calculation unit 204, the third acquisition unit 205, and the display control unit 215 described above are implemented by operation programs executed by the controller 101 illustrated in FIG. 3. Note that some or all of the functional units described above may be implemented by a hardware circuit such as the FPGA or ASIC, instead of the operation programs as software.

Note that FIG. 4 conceptually illustrates functions of the handheld printer 1 as functional units. The functional configuration of the handheld printer 1 is not limited to the functional configuration illustrated in FIG. 4. For example, some or all of the independent functional units illustrated in FIG. 4 may construct an integrated functional unit. By contrast, one or each of the functional units illustrated in FIG. 4 may be divided into multiple functional units.

Figure 5:
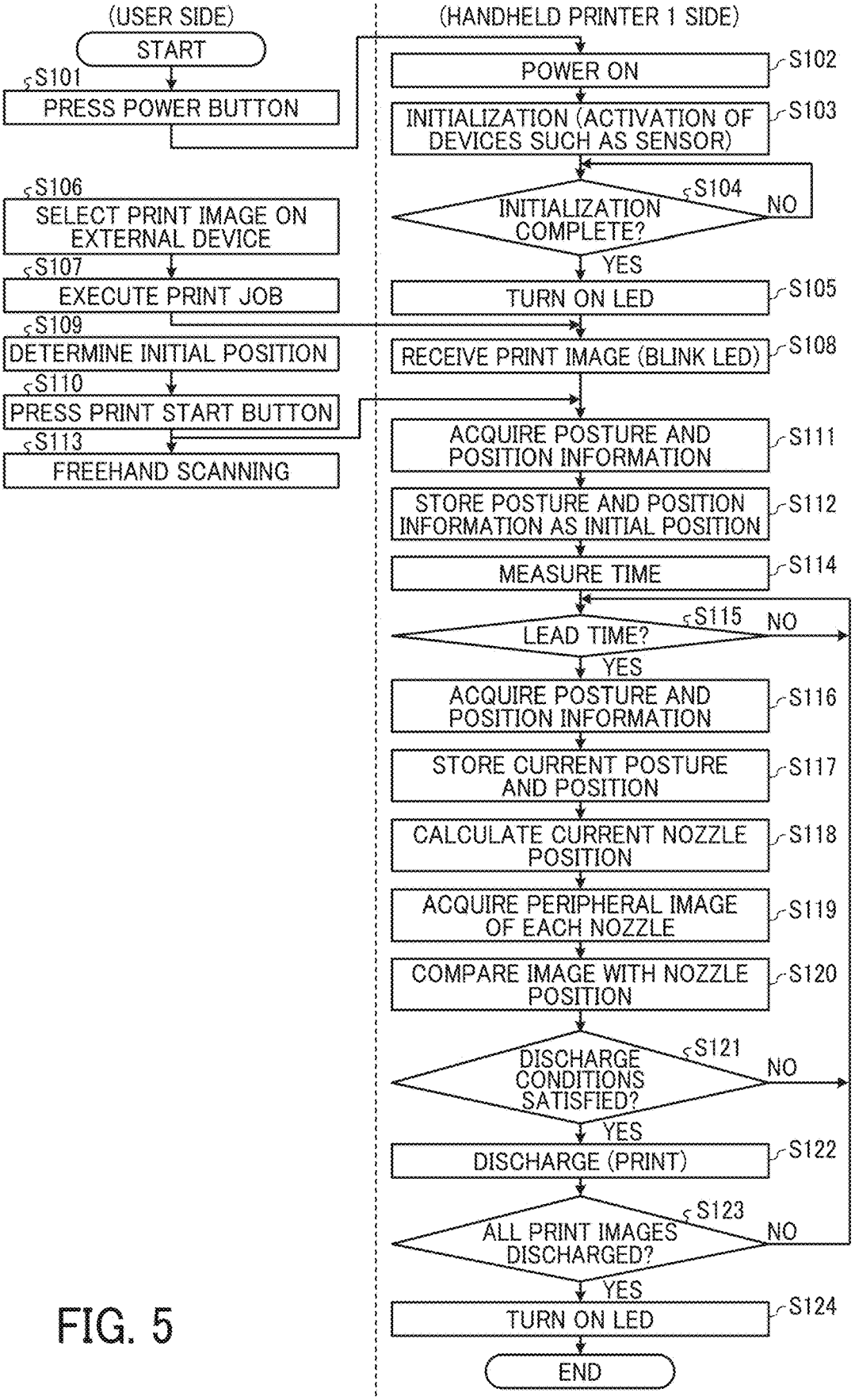
FIG. 5 is a flowchart of a printing process of the handheld printer according to the first embodiment.

Referring now to FIG. 5, a description is given of a general printing process of the handheld printer 1 according to the first embodiment.

FIG. 5 is a flowchart of a printing process of the handheld printer 1 according to the first embodiment.

In step S101, a user, for example, presses a power button of the handheld printer 1. Note that the power button may be one of the operation buttons 5 illustrated in FIG. 1A. Then, the process proceeds to S102.

In step S102, the devices of the handheld printer 1 are supplied with power from the battery 108 via the power supply circuit 109. Then, the process proceeds to S103.

In step S103, devices such as the controller 101 and the navigation sensor 106 are initialized and activated. Then, the process proceeds to S104.

In step S104, when the initialization of the devices such as the controller 101 and the navigation sensor 106 is complete (YES in step S104), the process proceeds to step S105. On the other hand, when the initialization is not complete (NO in step S104), the handheld printer 1 waits for the initialization to be complete.

In step S105, the display unit 216 turns on the LED 8, for example, to display that the initialization is complete and the handheld printer 1 is ready for printing. Then, the process proceeds to S108.

In step S106, the user operates the external device 10 to select image data to be printed (i.e., print image) in a tagged image file format (TIFF) or a joint photographic experts group (JPEG) format, for example.

In step S107, the user executes a print job. Specifically, the user operates the external device 10 so that the handheld printer 1 executes printing of the selected image data (i.e., print image) as a print job. The print job is transmitted from the external device 10 to the handheld printer 1. Then, the process proceeds to S108.

In step S108, in response to the print job (print image, image data) received by the communication unit 213 from the external device 10, the display unit 216 blinks the LED 8, for example, to display that the handheld printer 1 is receiving the print job. The first acquisition unit 201 acquires the print job received by the communication unit 213. Then, the process proceeds to S111.

In step S109, the user holds the handheld printer 1 and determines an initial position to print the print image on the print medium 20.

In step S110, the user instructs, with the operation unit 214, the handheld printer 1 to start printing. For example, the user presses a print start button to instruct the handheld printer 1 to start printing. Then, the process proceeds to steps S111 and S113.

In step S111, the second acquisition unit 203 acquires the posture and position information of the handheld printer 1 (precisely, the navigation sensor 106 itself) detected by the navigation sensor 106. Then, the process proceeds to S112.

In step S112, the second acquisition unit 203 stores, in the storage unit 217, the posture and position information thus acquired as the initial position. Then, the process proceeds to S114.

In step S113, the user starts freehand scanning.

In step S114, the controller 101 starts measuring the time to obtain a lead time for acquiring the posture and position information detected by the navigation sensor 106. Then, the process proceeds to S115.

In step S115, when the lead time has elapsed, in other words, when the time measured by the controller 101 comes to the time to acquire the posture and position information of the navigation sensor 106 (YES in step S115), the process proceeds to step S116. On the other hand, when the lead time has not elapsed (NO in step S115), the second acquisition unit 203 waits for the lead time to elapse.

In step S116, the second acquisition unit 203 acquires the posture and position information of the handheld printer 1 (precisely, the navigation sensor 106 itself) detected by the navigation sensor 106.

In step S117, the second acquisition unit 203 stores the posture and position information as current posture and position information in the storage unit 217. Note that, when the information detected by the navigation sensor 106 is a moving amount, the second acquisition unit 203 adds the moving amount thus detected to previous posture and position, thereby obtaining the current posture and position information. Then, the process proceeds to S118.

In step S118, the posture and position calculation unit 204 calculates, as a current nozzle position, the position of each nozzle of the recording head 104, from the current posture and position information of the navigation sensor 106 acquired by the second acquisition unit 203.

In step S119, the third acquisition unit 205 acquires a peripheral image of each nozzle. Specifically, the third acquisition unit 205 acquires a peripheral image, in the image data of the print job, corresponding to the current nozzle position calculated by the posture and position calculation unit 204. Then, the process proceeds to S120.

In step S120, the print control unit 202 compares a print position of the image data to be printed on the print medium 20 and the current nozzle position, that is, the position of each nozzle of the recording head 104, calculated by the posture and position calculation unit 204.

In step S121, when the print position and the current nozzle position satisfy given conditions (i.e., discharge conditions) (YES in step S121), the process proceeds to step S122. On the other hand, when the print position and the current nozzle position does not satisfy the given conditions (i.e., discharge conditions) (NO in step S121), the process returns to step S115. Note that the given conditions (i.e., discharge conditions) are herein whether the print position and the current nozzle position coincide, or whether the print position and the current nozzle position are close to each other enough to be regarded as coincident positions.

In step S122, the print control unit 202 transmits a timing signal to the recording head drive circuit 103 to cause the recording head 104 to discharge ink from target nozzles of the recording head 104 onto the print position. Then, the process proceeds to S123.

In step S123, when all the image data (i.e., print data) of the print job is printed (or discharged) (YES in step S123), the process proceeds to step S124. On the other hand, when not all the image data (i.e., print data) of the print job is printed (or discharged) (NO in step S123), the process returns to step S115. By repeating steps S115 to S123 described above, the handheld printer 1 forms the print image on the print medium 20.

In step S124, the display unit 216 turns on the LED 8, for example, to display that the printing is complete. Note that, when the user determines that the printing is sufficient even when not all the image data is printed, the user may instruct, with the operation unit 214, the handheld printer 1 to stop printing. In this case, the handheld printer 1 determines that the printing is complete.

The handheld printer 1 executes the regular printing along the steps S101 to S124 described above.

Referring now to FIGS. 6A to 8, a description is given of some locations of a USB connector in a comparative handheld printer 500.

Figure 6A:
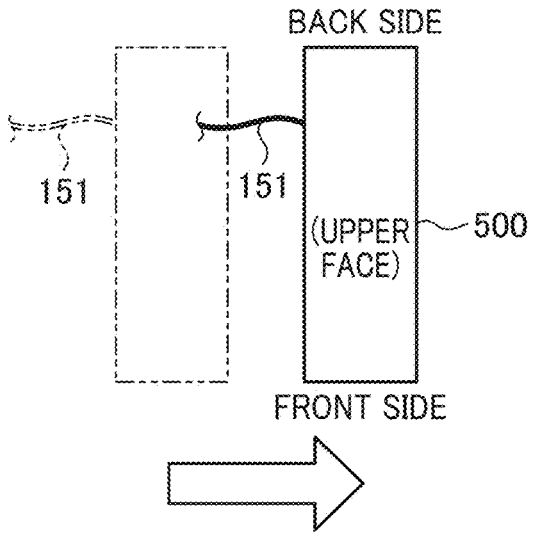
FIG. 6A is a diagram illustrating a state in which a comparative handheld printer is moved with a USB cable for printing.
Figure 6B:
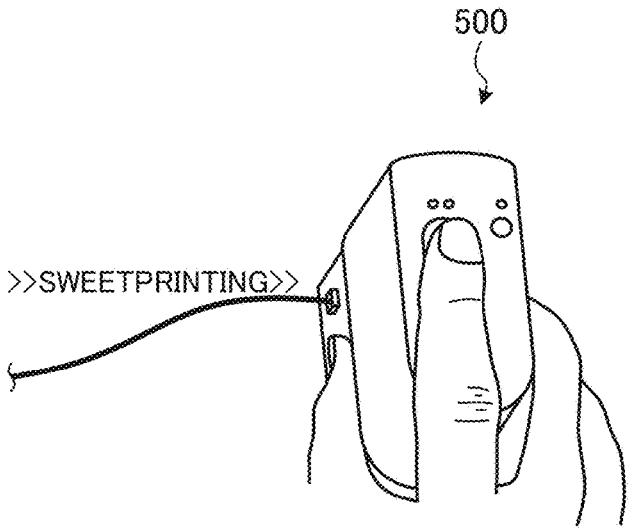
FIG. 6B is a diagram illustrating an image printed by the movement of the comparative handheld printer.
Figure 7:
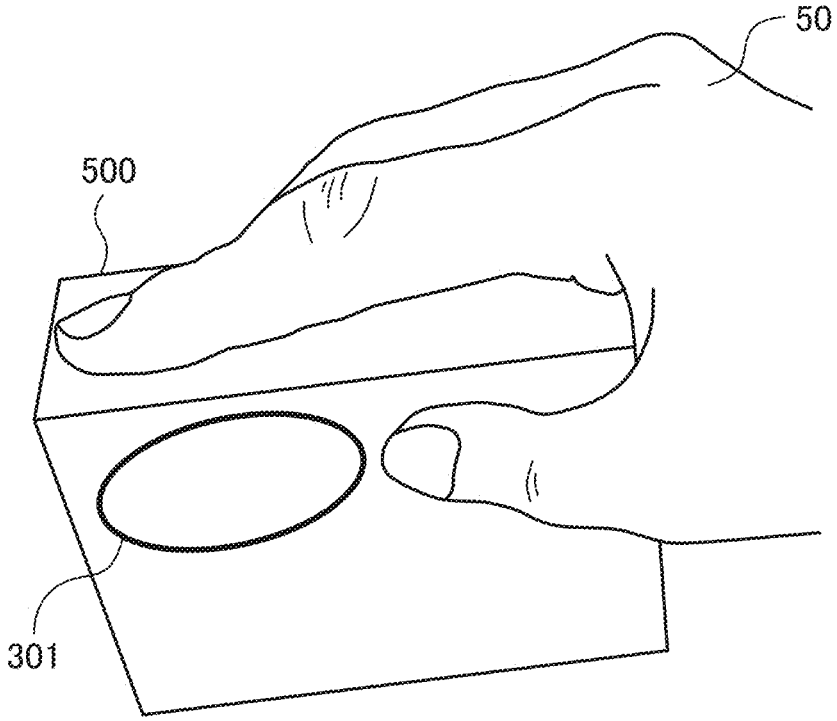
FIG. 7 is a view of the comparative handheld printer held, illustrating a first connection area of the USB cable that does not disturb the operation of the comparative handheld printer.
Figure 8:
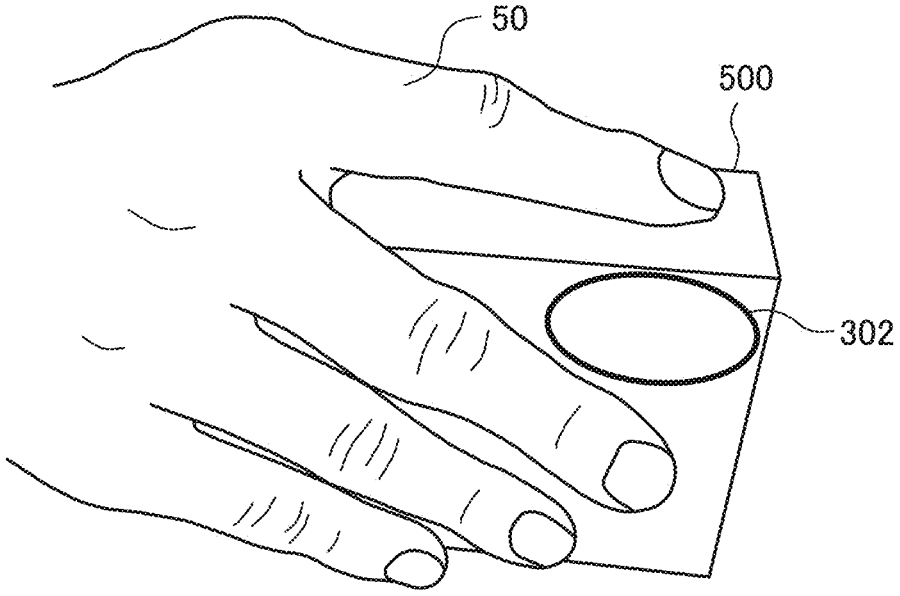
FIG. 8 is another view of the comparative handheld printer held, illustrating a second connection area of the USB cable that does not disturb the operation of the comparative handheld printer.

FIG. 6A is a diagram illustrating a state in which the comparative handheld printer 500 is moved with the USB cable 151 for printing. FIG. 6B is a diagram illustrating an image printed by the movement of the comparative handheld printer 500. FIG. 7 is a view of the comparative handheld printer 500 held, illustrating a first connection area 301 of the USB cable 151 that does not disturb the operation of the comparative handheld printer 500. FIG. 8 is another view of the comparative handheld printer 500 held, illustrating a second connection area 302 of the USB cable 151 that does not disturb the operation of the comparative handheld printer 500.

Specifically, FIGS. 6A to 8 illustrate the comparative handheld printer 500 as a handheld printer to describe where to locate a USB connector and the influence of the USB connector disposed at a particular location. The handheld printer 1 and the comparative handheld printer 500 have substantially the same configuration, except for the location of a USB connector (e.g., USB connector 9).

As illustrated in FIG. 6A, the USB cable 151 is connected to the comparative handheld printer 500, via a USB connector that is disposed on a lower, back side of a left side face (corresponding to the left side face 31 in FIG. 1B) of the comparative handheld printer 500. FIG. 6A illustrates a state in which the comparative handheld printer 500 is moved to scan rightward during printing. FIG. 6B illustrates a result of the rightward movement illustrated in FIG. 6A. Specifically, as the ink is discharged from an opening (corresponding to the opening 6 in FIG. 1B) located on the back side of a lower face (corresponding to the lower face 11 in FIG. 1B) of the comparative handheld printer 500, a character string "»SWEETPRINTING«" is printed as an image on a print medium. FIG. 6B also illustrates the USB cable 151 in contact with the image immediately after the image is printed. In other words, the USB cable 151 is in contact with incompletely dried ink of the image. Such a contact stretches or rubs the ink, leading to image degradation.

FIG. 7 is a left side view of the comparative handheld printer 500 held by a user's hand 50.

As illustrated in FIG. 7, the user's hand 50 entirely covers an upper face (corresponding to the upper face 22 in FIG. 1A) of the comparative handheld printer 500. When a USB connector is disposed on the upper face of the comparative handheld printer 500, the USB cable 151 connected to the USB connector may interfere with the user's hand 50 holding the comparative handheld printer 500. Such an interference may disturb the user to hold the comparative handheld printer 500, causing difficulties in print scanning.

FIG. 7 illustrates the first connection area 301 on an upper, back side of the left side face of the comparative handheld printer 500. In other words, the first connection area 301 is an area closer to the back side and the upper face than the front side and the lower face, respectively, of the comparative handheld printer 500. The first connection area 301 is an area in which the user's hand 50 is not placed. That is, when a USB connector is disposed in the first connection area 301, the USB cable 151 connected to the USB connector does not interfere with the user's hand 50. Accordingly, the operability is maintained without difficulties in the scanning operation at the time of printing. In addition, the first connection area 301 is distanced from the print medium 20. Therefore, the USB cable 151 connected to the USB connector in the first connection area 301 rarely contacts a printed image on the print medium 20. That is, the USB cable 151 rarely stretches or rubs ink of the printed image, thereby preventing the image deterioration.

On the other hand, in the example of FIG. 7, the thumb of the user's hand 50 is placed on an upper portion in a front side area on the left side face of the comparative handheld printer 500. However, some users may prefer to place the thumb on a lower portion in the front side area on the left side face of the comparative handheld printer 500, to hold the comparative handheld printer 500 for scanning. That is, it depends on the user where to place the thumb in the front side area on the left side face of the comparative handheld printer 500. It is undesirable to locate a USB connector in such an area where it is unclear whether the user places a finger.

FIG. 8 is a right side view of the comparative handheld printer 500 held by the user's hand 50.

FIG. 8 illustrates the second connection area 302 on an upper, back side of a right side face (corresponding to the right side face 32 in FIG. 1B) of the comparative handheld printer 500. The second connection area 302 is an area in which the user's hand 50 is not placed. That is, when a USB connector is disposed in the second connection area 302, the USB cable 151 connected to the USB connector does not interfere with the user's hand 50. Accordingly, the operability is maintained without difficulties in the scanning operation at the time of printing. In addition, the second connection area 302 is distanced from the print medium 20. Therefore, the USB cable 151 connected to the USB connector in the second connection area 302 rarely contacts a printed image on the print medium 20. That is, the USB cable 151 rarely stretches or rubs ink of the printed image, thereby preventing the image deterioration.

On the other hand, as illustrated in FIG. 8, the user's hand 50 is likely to be placed in an area below the second connection area 302. When a USB connector is disposed on the upper face of the comparative handheld printer 500, the USB cable 151 connected to the USB connector may interfere with the user's hand 50 holding the comparative handheld printer 500. Such an interference may disturb the user to hold the comparative handheld printer 500, causing difficulties in print scanning.

In the example illustrated in FIG. 8, the middle finger, the ring finger, and the little finger of the user's hand 50 entirely cover a front side area on the right side face of the comparative handheld printer 500. However, some users may prefer to place the middle finger alone on any portion of the front side area on the right side face of the comparative handheld printer 500, to hold the comparative handheld printer 500 for scanning. In this case, the user's hand 50 does not cover the portion other than the portion covered by the middle finger. That is, it depends on the user where to place a finger in the front side area on the right side face of the comparative handheld printer 500. It is undesirable to locate a USB connector in such an area where it is unclear whether the user places a finger.

Figure 9A:
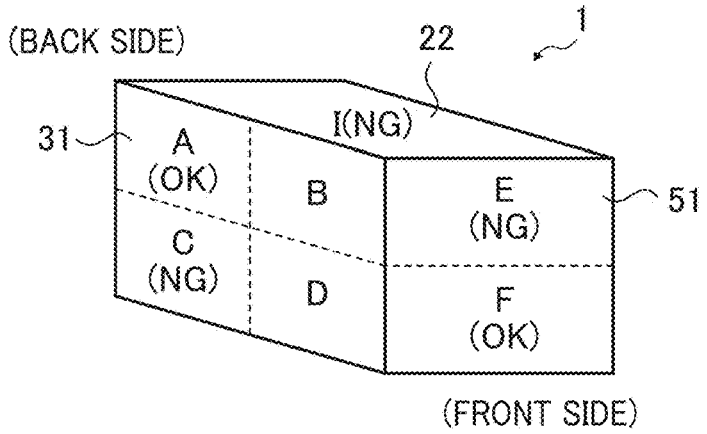
FIG. 9A is a diagram illustrating some possible locations of a USB connector in the handheld printer according to the first embodiment.
Figure 9B:
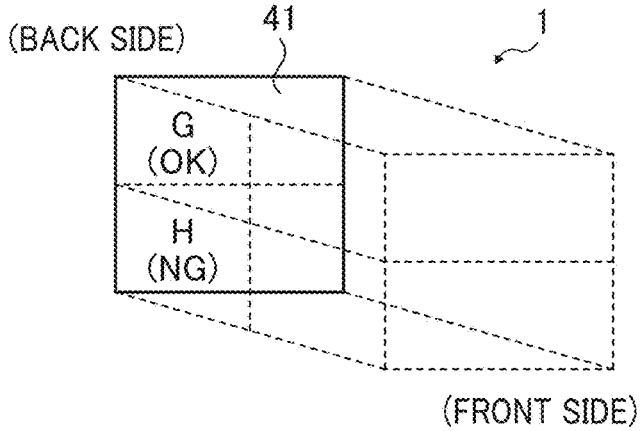
FIG. 9B is another diagram illustrating some other possible locations of the USB connector in the handheld printer according to the first embodiment.
Figure 9C:
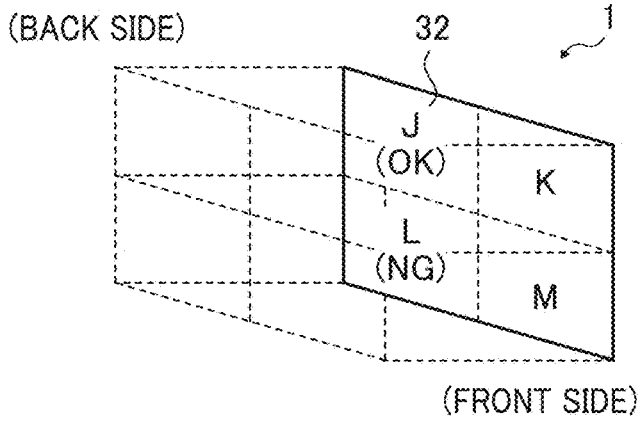
FIG. 9C is yet another diagram illustrating residual possible locations of the USB connector in the handheld printer according to the first embodiment.

In light of the consideration as described above with reference to FIGS. 6A to 8, a description is now given of possible locations of the USB connector 9 in the handheld printer 1 according to the first embodiment with reference to FIGS. 9A to 9C.

FIG. 9A is a diagram illustrating some possible locations of the USB connector 9 in the handheld printer 1 according to the first embodiment. FIG. 9B is another diagram illustrating some other possible locations of the USB connector 9 in the handheld printer 1 according to the first embodiment. FIG. 9C is yet another diagram illustrating residual possible locations of the USB connector 9 in the handheld printer 1 according to the first embodiment.

As illustrated in FIG. 9A, the left side face 31 of the handheld printer 1 is divided into four areas A, B, C, and D. The area A is an upper, back side area. The area B is an upper, front side area. The area C is a lower, back side area. The area D is a lower, front side area. The upper face 22 of the handheld printer 1 is herein defined as an area I. The front side face 51 (i.e., fifth face) of the handheld printer 1 is divided into two areas E and F. The area E is an upper area; whereas the area F is a lower area (i.e., area closer to the lower face 11 than the upper face 22). Note that the front side face 51 is a face opposite a face on the recording head side.

The area A corresponds to the first connection area 301 illustrated in FIG. 7. The area A is an area in which the user's hand 50 is not placed. In addition, when the USB connector 9 is disposed in the area A, the USB cable 151 connected to the USB connector 9 rarely contacts a printed image. Accordingly, the operability is maintained without difficulties in the scanning operation at the time of printing. The USB cable 151 apart from the printed image rarely stretches or rubs ink of the printed image, thereby preventing the image degradation. Accordingly, the area A is suitable as a location of the USB connector 9.

The area C corresponds to a lower, back side area on the left side face described above with reference to FIGS. 6A and 6B (i.e., the area below the first connection area 301 illustrated in FIG. 7). When the USB connector 9 is disposed in the area C, the USB cable 151 connected to the USB connector 9 may contact an image immediately after the image is printed. In other words, the USB cable 151 may contact incompletely dried ink of the image. Such a contact may stretch or rub the ink, leading to the image degradation. Accordingly, the area C is unsuitable as a location of the USB connector 9.

The areas B and D correspond to a front side area on the left side face described above with reference to FIG. 7. It depends on the user whether to place a finger in the areas B and D. In other words, it is unclear whether the user places a finger in the areas B and D. When the USB connector 9 is disposed in the area B or D and the user places a finger in the area B or D, the USB cable 151 connected to the USB connector 9 interferes with the user's hand 50 holding the handheld printer 1. Such an interference disturbs the user to hold the handheld printer 1, causing difficulties in print scanning. Accordingly, the areas B and D are unsuitable as locations of the USB connector 9.

The area I corresponds to the upper face of the comparative handheld printer 500 described above with reference to FIG. 7. When the USB connector 9 is disposed in the area I, the USB cable 151 connected to the USB connector 9 interferes with the user's hand 50 holding the handheld printer 1. Such an interference disturbs the user to hold the handheld printer 1, causing difficulties in print scanning. Accordingly, the area I is unsuitable as a location of the USB connector 9.

When the USB connector 9 is disposed in the area E, the USB cable 151 connected to the USB connector 9 may interfere with the user's hand 50 holding the handheld printer 1 as analogized from FIGS. 7 and 8. Such an interference may disturb the user to hold the handheld printer 1, causing difficulties in print scanning. Accordingly, the area E is unsuitable as a location of the USB connector 9.

When the USB connector 9 is disposed in the area F, the USB cable 151 connected to the USB connector 9 does not interfere with the user's hand 50 holding the handheld printer 1. In addition, when the user moves the handheld printer 1 from back to front instead of a lateral scanning, or from the back side face 41 to the front side face 51 in the lateral scanning, an image is yet to be printed on the print medium 20 near the area F. That is, the USB cable 151 does not contact a printed image. Accordingly, the operability is maintained without difficulties in the scanning operation at the time of printing. The USB cable 151 apart from the printed image rarely stretches or rubs ink of the printed image, thereby preventing the image degradation. Accordingly, the area F is suitable as a location of the USB connector 9.

Referring now to FIG. 9B, a description is given of some other possible locations of the USB connector 9.

As illustrated in FIG. 9B, a back side face 41 (i.e., fourth face) of the handheld printer 1 is divided into two areas G and H. The area G is an upper area (i.e., area closer to the upper face 22 than the lower face 11); whereas the area H is a lower area. Note that the back side face 41 is the face on the recording head side.

The area G is an area in which the user's hand 50 is not placed. In addition, when the USB connector 9 is disposed in the area G, the USB cable 151 connected to the USB connector 9 rarely contacts a printed image. Accordingly, the operability is maintained without difficulties in the scanning operation at the time of printing. The USB cable 151 apart from the printed image rarely stretches or rubs ink of the printed image, thereby preventing the image degradation. Accordingly, the area G is suitable as a location of the USB connector 9.

When the USB connector 9 is disposed in the area H, the USB cable 151 connected to the USB connector 9 does not contact a printed image immediately after the image is printed. However, since the USB connector 9 is located close to the print medium 20, the USB cable 151 may contact incompletely dried ink of the image. Such a contact may stretch or rub the ink, leading to the image degradation. Accordingly, the area H is unsuitable as a location of the USB connector 9.

Referring now to FIG. 9C, a description is given of residual possible locations of the USB connector 9.

As illustrated in FIG. 9C, the right side face 32 of the handheld printer 1 is divided into four areas J, L, K, and M. The area J is an upper, back side area. The area K is an upper, front side area. The area L is a lower, back side area. The area M is a lower, front side area.

The area J corresponds to the second connection area 302 illustrated in FIG. 8. The area J is an area in which the user's hand 50 is not placed. In addition, when the USB connector 9 is disposed in the area J, the USB cable 151 connected to the USB connector 9 rarely contacts a printed image. Accordingly, the operability is maintained without difficulties in the scanning operation at the time of printing. The USB cable 151 apart from the printed image rarely stretches or rubs ink of the printed image, thereby preventing the image degradation. Accordingly, the area J is suitable as a location of the USB connector 9.

When the USB connector 9 is disposed in the area L, the USB cable 151 connected to the USB connector 9 may contact a printed image immediately after the image is printed during a leftward movement of the handheld printer 1 for scanning. In other words, the USB cable 151 may contact incompletely dried ink of the image. Such a contact may stretch or rub the ink, leading to the image degradation. Accordingly, the area L is unsuitable as a location of the USB connector 9.

The areas K and M correspond to a front side area on the right side face described above with reference to FIG. 8. It depends on the user whether to place a finger in the areas K and M. In other words, it is unclear whether the user places a finger in the areas K and M. When the USB connector 9 is disposed in the area K or M and the user places a finger in the area K or M, the USB cable 151 connected to the USB connector 9 interferes with the user's hand 50 holding the handheld printer 1, causing difficulties in print scanning. Accordingly, the areas K and M are unsuitable as locations of the USB connector 9.

As described above, in the handheld printer 1 according to the present embodiment, the USB connector 9 is disposed in at least one of the areas A, F, G, and J, among the areas A to M illustrated in FIGS. 9A to 9C. Note that the location of the USB connector 9 is not limited to one location. Alternatively, a plurality of USB connectors 9 may be located in the above-described possible (or suitable) locations.

Note that the lines defining the areas A to M in FIGS. 9A to 9C are merely examples. For example, an area is divided in half, in the longitudinal direction of the handheld printer 1, into the areas A and B. Alternatively, however, the area may be divided not in half, in the longitudinal direction of the handheld printer 1, into the areas A and B. That is, the lines defining the areas A to M serve as merely indicators for separating the areas A to M for each other.

Referring now to FIGS. 10A to 12, a description is given of some other adverse effects of locating a USB connector in the unsuitable areas described above with reference to FIGS. 9A to 9C.

Figure 10A:
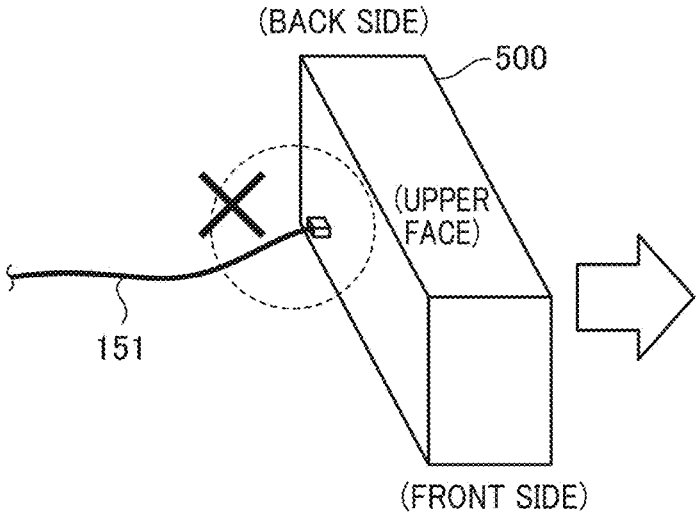
FIG. 10A is a diagram illustrating a first example of unsuitable location of a USB connector in the comparative handheld printer.
Figure 10B:
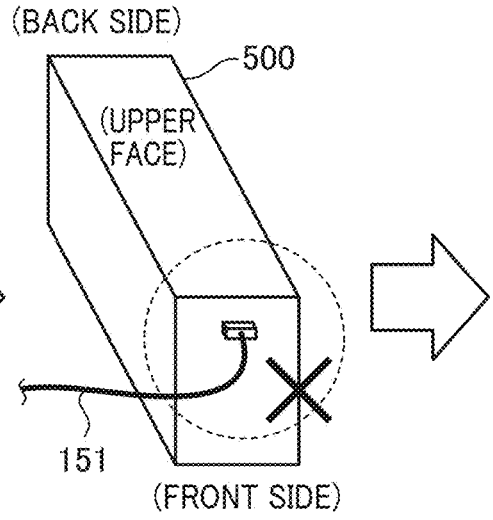
FIG. 10B is a diagram illustrating a second example of unsuitable location of a USB connector in the comparative handheld printer.
Figure 11:
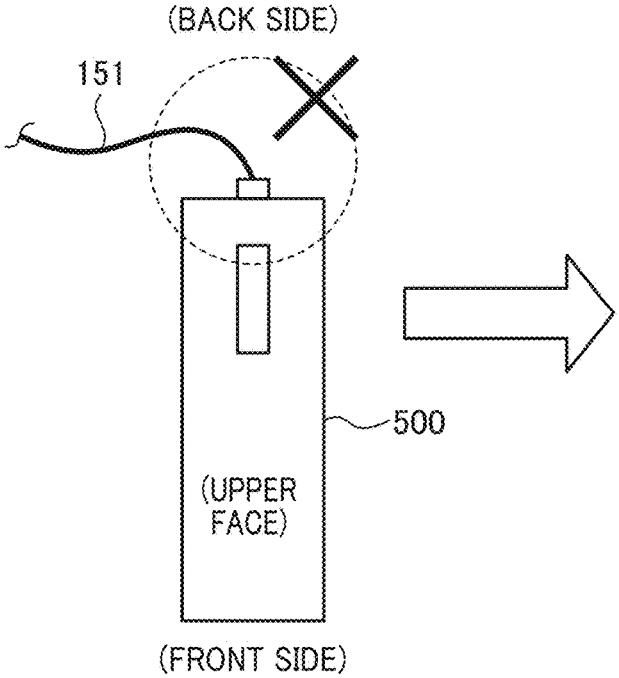
FIG. 11 is a diagram illustrating a third example of unsuitable location of a USB connector in the comparative handheld printer.
Figure 12:
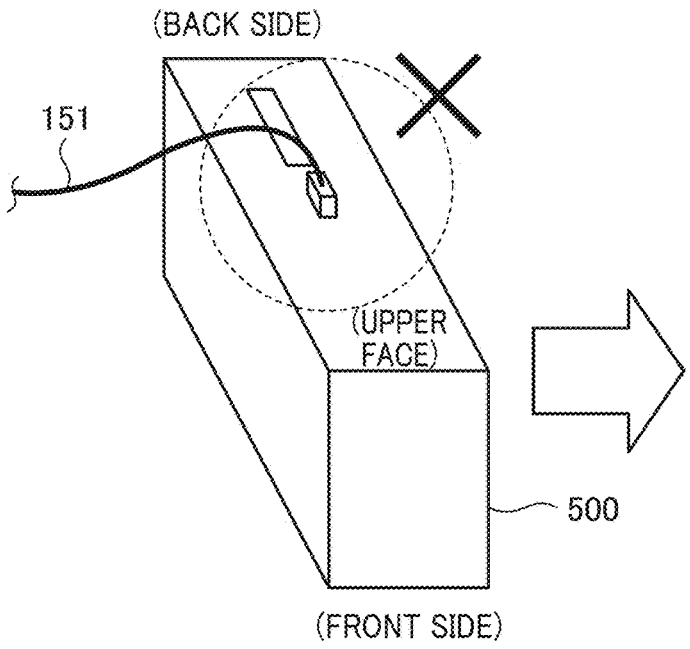
FIG. 12 is a diagram illustrating a fourth example of unsuitable location of a USB connector in the comparative handheld printer.

FIGS. 10A to 12 illustrate examples of unsuitable location of the USB connector in the comparative handheld printer 500. Specifically, FIG. 10A is a diagram illustrating a first example of the unsuitable location of the USB connector in the comparative handheld printer 500. FIG. 10B is a diagram illustrating a second example of the unsuitable location of the USB connector in the comparative handheld printer 500. FIG. 11 is a diagram illustrating a third example of the unsuitable location of the USB connector in the comparative handheld printer 500. FIG. 12 is a diagram illustrating a fourth example of the unsuitable location of the USB connector in the comparative handheld printer 500.

Similar to FIGS. 6A to 8, FIGS. 10A to 12 illustrate the comparative handheld printer 500 as a handheld printer to describe the adverse effects of locating a USB connector in a particular area.

FIG. 10A illustrates the USB cable 151 connected to a USB connector disposed in an area, corresponding the area C illustrated in FIG. 9A, in the comparative handheld printer 500.

In this case, as described above, the USB cable 151 contacts incompletely dried ink of a printed image. Such a contact may stretch or rub the ink, leading to the image degradation. In addition, the USB cable 151 rubbing on the print medium 20 generates resistance that hampers the print scanning, thus causing an adverse effect. Such an adverse effect may also occur when the USB connector is disposed in an area, corresponding to the area L illustrated in FIG. 9C, on the right side face of the comparative handheld printer 500.

FIG. 10B illustrates the USB cable 151 connected to a USB connector disposed in an area, corresponding the area E illustrated in FIG. 9A, in the comparative handheld printer 500.

In this case, as described above, the USB cable 151 interferes with the user's hand 50. Such an interference disturbs the user to hold the comparative handheld printer 500, causing difficulties in print scanning. In addition, the USB cable 151 is connected to the USB connector at a right angle to the scanning direction. That is, the USB cable 151 may be excessively bent and broken, as an adverse effect. Such an undesirable bending state of the USB cable 151 is to be avoided because the comparative handheld printer 500 scans for a longer distance (e.g., 60 cm) than an operational distance of a mouse.

FIG. 11 illustrates the USB cable 151 connected to a USB connector disposed in an area, corresponding the area H illustrated in FIG. 9B, in the comparative handheld printer 500.

In this case, as described above, the USB connector is located close to the print medium 20. The USB cable 151 connected to the USB connector contacts incompletely dried ink of a printed image. Such a contact may stretch or rub the ink, leading to the image degradation. In addition, the USB cable 151 is connected to the USB connector at a right angle to the scanning direction. That is, the USB cable 151 may be excessively bent and broken, as an adverse effect. Such an undesirable bending state of the USB cable 151 is to be avoided because the comparative handheld printer 500 scans for a longer distance than the operational distance of a mouse, as described above with reference to FIG. 10B.

FIG. 12 illustrates the USB cable 151 connected to a USB connector disposed in an area, corresponding the area I illustrated in FIG. 9A, in the comparative handheld printer 500.

In this case, as described above, the USB cable 151 interferes with the user's hand 50. Such an interference disturbs the user to hold the comparative handheld printer 500, causing difficulties in print scanning. In addition, the USB cable 151 is connected to the USB connector at a right angle to the scanning direction. That is, the USB cable 151 may be excessively bent and broken. Further, the USB cable 151 overlaps the user's eye line to the comparative handheld printer 500, disturbing, as an adverse effect, the user to see operation buttons (corresponding to the operation buttons 5 illustrated in FIG. 1A) disposed in the area I.

As described above, depending on the location of the USB connector 9 in the handheld printer 1, the USB cable 151 connected to the USB connector 9 may interfere with the user's hand 50 during printing and disturb the user to move the handheld printer 1 for print scanning, or may deteriorate the printed image. To address such a situation, in the handheld printer 1 according to the present embodiment, the USB connector 9 is located in at least one of the area A (i.e., the upper, back side area on the left side face 31), the area F (i.e., the lower area on the front side face 51), the area G (i.e., the upper area on the back side face 41), and the area J (i.e., the upper, back side area on the right side face 32) described above with reference to FIGS. 9A to 9C. In this case, when the handheld printer 1 is held and moved for scanning as a print operation with the USB cable 151 connected to the USB connector 9, the USB cable 151 does not disturb the print operation or contact a printed image. That is, the USB cable 151 apart from the printed image prevents deterioration of the printed image.

Figure 13:
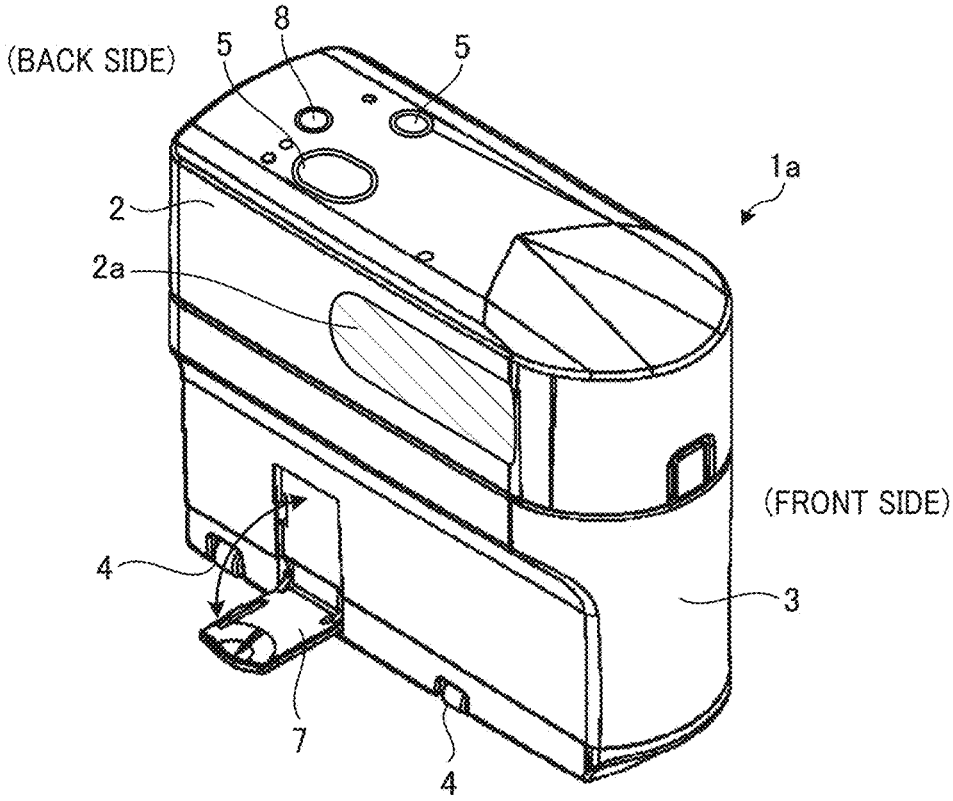
FIG. 13 is an external perspective view of a handheld printer according to a second embodiment of the present disclosure.
Figure 14A:
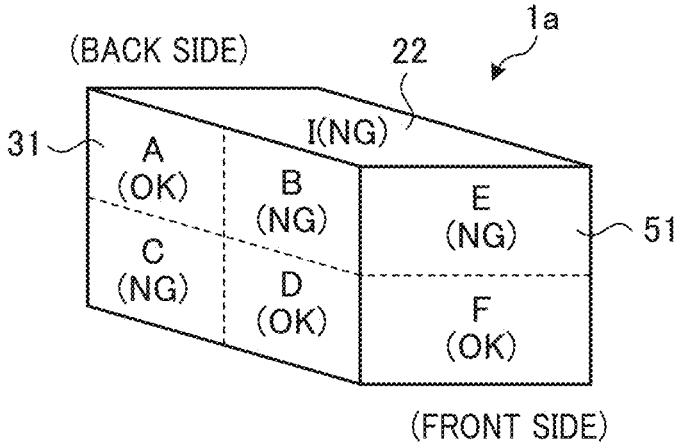
FIG. 14A is a diagram illustrating some possible locations of a USB connector in the handheld printer according to the second embodiment.
Figure 14B:
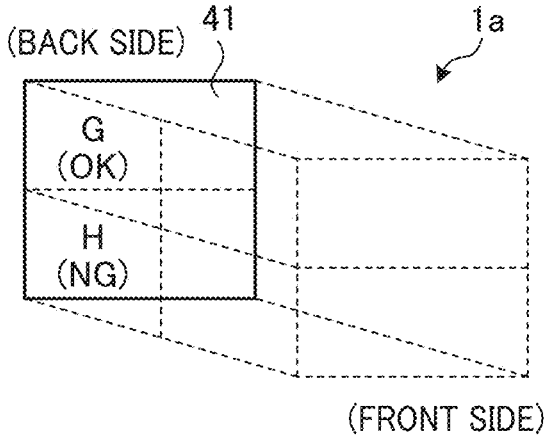
FIG. 14B is another diagram illustrating some other possible locations of the USB connector in the handheld printer according to the second embodiment.
Figure 14C:
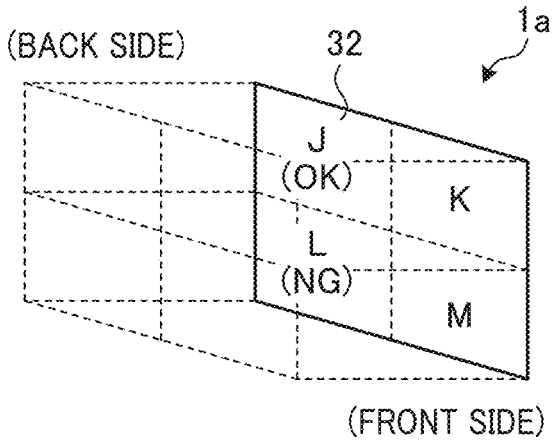
FIG. 14C is yet another diagram illustrating residual possible locations of the USB connector in the handheld printer according to the second embodiment.

Referring now to FIGS. 13 to 14C, a description is given of a handheld printer 1*a* according to a second embodiment of the present disclosure, focusing on differences from the handheld printer 1 according to the first embodiment.

In the first embodiment, the location of the USB connector 9 is described in consideration of which part or area of the handheld printer 1 is held by the user. Since it depends on the user how to hold the handheld printer 1, it is unclear whether the user places a finger with respect to some of the parts or areas of the handheld printer 1. According to the first embodiment, such parts or areas are described as unsuitable locations of the USB connector 9. In the second embodiment, the handheld printer 1*a* is provided with a recessed guide 2*a* for a user to hold the handheld printer 1*a*. The recessed guide 2*a* facilitates specification of possible (or suitable) locations and unsuitable locations of the USB connector 9.

Initially with reference to FIG. 13, a description is given of an external configuration of the handheld printer 1*a* according to the second embodiment.

FIG. 13 is an external perspective view of the handheld printer 1*a* according to the second embodiment.

As illustrated in FIG. 13, the handheld printer 1*a*, serving as a handheld recording device, includes the upper unit 2 and the lower unit 3.

As illustrated in FIG. 13, the recessed guide 2*a* is provided in the upper unit 2, in a front side area (i.e., an area closer to the front side than the back side) on the left side face 31 of the handheld printer 1*a*. The recessed guide 2*a* serves as a guidance for finger placement when a user holds the handheld printer 1*a*. For example, the user places a right thumb in the recessed guide 2*a* when holding the handheld printer 1*a* with the right hand. Note that, in the present embodiment, the recessed guide 2*a* is provided as a guidance for finger placement. Alternatively, a plurality of bulges may be provided as a guide or guidance to indicate where to place a finger. A detailed description of the location of the USB connector 9 in the handheld printer 1*a* is deferred. Note that the handheld printer 1*a* of the second embodiment and the handheld printer 1 of the first embodiment have substantially the same configurations except that the handheld printer 1*a* includes the recessed guide 2*a*.

Referring now to FIGS. 14A to 14C, a description is given of possible locations of the USB connector 9 in the handheld printer 1*a* according to the second embodiment.

FIG. 14A is a diagram illustrating some possible locations of the USB connector 9 in the handheld printer 1*a* according to the second embodiment. FIG. 14B is another diagram illustrating some other possible locations of the USB connector 9 in the handheld printer 1*a* according to the second embodiment. FIG. 14C is yet another diagram illustrating residual possible locations of the USB connector 9 in the handheld printer 1*a* according to the second embodiment.

Among areas in the handheld printer 1*a* illustrated in FIG. 14A to 14C, the areas A, C, E, F, G, H, I, J, and L are as described above in the first embodiment.

The area B is an upper, front side area on the left side face 31 of the handheld printer 1*a*. The area B corresponds to an area in which the recessed guide 2*a* is provided in FIG. 13. That is, the user places a finger in the recessed guide 2*a* provided in the area B, thereby holding the handheld printer 1*a*. Accordingly, the area B is unsuitable as a location of the USB connector 9.

On the other hand, the area D is a lower, front side area on the left side face 31 of the handheld printer 1*a*. Since the user places a finger (e.g., right thumb) in the recessed guide 2*a* provided in the area B when holding the handheld printer 1*a*, the user places no fingers in the area D. When the USB connector 9 is disposed in the area D, the USB cable 151 connected to the USB connector 9 does not interfere with the user's hand 50 holding the handheld printer 1*a*. In addition, when the user moves the handheld printer 1*a* from back to front instead of a lateral scanning, or from the back side face 41 to the front side face 51 in the lateral scanning, an image is yet to be printed on the print medium 20 near the area D. That is, the USB cable 151 does not contact a printed image. Accordingly, the operability is maintained without difficulties in the scanning operation at the time of printing. The USB cable 151 apart from the printed image rarely stretches or rubs ink of the printed image, thereby preventing the image degradation. Accordingly, the area D is suitable as a location of the USB connector 9.

Note that, in the example illustrated in FIG. 13, the recessed guide 2*a* is provided in the area B. Alternatively, however, the recessed guide 2*a* may be provided in the area D. In this case, the area D is unsuitable as a location of the USB connector 9; whereas the area B is suitable as a location of the USB connector 9.

The areas K and M correspond to the front side area on the right side face described above with reference to FIG. 8. It depends on the user whether to place a finger in the areas K and M. In other words, it is unclear whether the user places a finger in the areas K and M. Accordingly, as described above in the first embodiment, the areas K and M are unsuitable as locations of the USB connector 9. However, when a recess for finger placement like the recessed guide 2*a* is provided in the area K or M to specify an area for finger placement on the right side face 32 of the handheld printer 1*a*, an area other than the area thus specified is suitable as a location of the USB connector 9. In other words, an area in which the user's finger is not placed is suitable as a location of the USB connector 9.

As described above, in the handheld printer 1*a* according to the present embodiment, the USB connector 9 is locatable in at least one of the areas A, D, F, G, and J, among the areas A to M illustrated in FIGS. 14A to 14C. The recessed guide 2*a* provided in the area B enables the area D, of the areas A, D, F, G, and J, to be a possible location of the USB connector 9. In addition, as described above, when a recess for finger placement like the recessed guide 2*a* is provided in the area K or M, an area other than the area specified (i.e., an area in which the user's finger is not placed) is suitable as a location of the USB connector 9. Thus, when the handheld printer 1*a* is held and moved for scanning as a print operation with the USB cable 151 connected to the USB connector 9 located in a suitable area, the USB cable 151 does not disturb the print operation or contact a printed image. That is, the USB cable 151 apart from the printed image prevents deterioration of the printed image.

Referring now to FIGS. 15 to 17C, a description is given of a handheld printer 1*b* according to a third embodiment of the present disclosure, focusing on differences from the handheld printer 1 according to the first embodiment and the handheld printer 1*a* according to the second embodiment.

In the handheld printers 1 and 1*a* of the first and second embodiments, respectively, each of the left side face 31 and the right side face 32 is divided into four areas, to describe possible (or suitable) locations and unsuitable locations of the USB connector 9. In the handheld printer 1*b* of the third embodiment, each of the left side face 31 and the right side face 32 is divided into an upper portion and a lower portion, to describe possible (or suitable) locations and unsuitable locations of a USB connector 9*b*.

Figure 15:
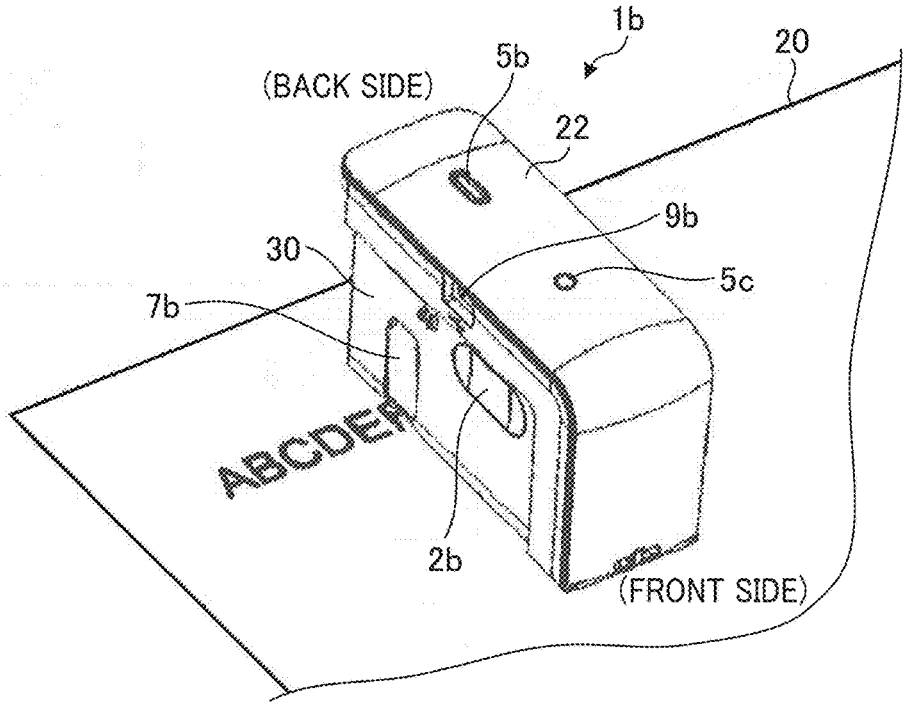
FIG. 15 is an external perspective view of a handheld printer according to a third embodiment of the present disclosure.

Initially with reference to FIG. 15, a description is given of an external configuration of the handheld printer 1*b* according to the third embodiment.

FIG. 15 is an external perspective view of the handheld printer 1*b* according to the third embodiment.

As illustrated in FIG. 15, a main body 30 of the handheld printer 1*b* has a control board mounted inside. The upper face 22 of the handheld printer 1*b* is provided with an operation button 5*b* and a power button 5*c*. A user, for example, performs various operations with the operation button 5. The user turns on and off the handheld printer 1*b* with the power button 5*c*.

The main body 30 is further provided with a guide part 7*b* on one side face, in this case, on the left side face 31. With the guide part 7*b*, the user ascertains a print area (i.e., an area in which, e.g., an image is printed) on the print medium 20 upon printing. The guide part 7*b* and the guide part 7 described above with reference to FIGS. 1A and 1B have substantially the same functions. The main body 30 of the handheld printer 1*b* has the recording head 104 aboard. The recording head 104 serves as a recorder to discharge ink. As illustrated in FIG. 1B, the handheld printer 1*b* has the opening 6 on the back side of the lower face 11. The ink discharged from the recording head 104 reaches the print medium 20, such as a sheet, from the opening 6 to form or record an image. The guide part 7*b* is released, similarly to the guide part 7 illustrated FIG. 1A, when the user ascertains the print area with the guide part 7*b*. On the other hand, when the user does not use the guide part 7*b*, the user pivots the guide part 7*b* about a hinge at a lower end of the guide part 7*b* and stores the guide part 7*b* in the left side face 31 of the main body 30 of the handheld printer 1.

Substantially at the center portion, in a longitudinal (i.e., front-to-back) direction of the handheld printer 1*b*, in an area close to the upper face 22 on the left side face 31 of the main body 30, the USB connector 9*b* (also referred to as a USB port) is disposed to be connected to the USB cable 151. Note that FIG. 15 illustrates the USB connector 9*b* having a longitudinal shape in a horizontal direction. Alternatively, the USB connector 9*b* may have a longitudinal shape in a vertical direction, which is perpendicular to the horizontal direction, to reduce the load on the USB connector 9*b* due to the load of the USB cable 151 connected to the USB connector 9*b*. Note that the location of the USB connector 9*b* illustrated in FIG. 15 is merely an example. A detailed description of the location of the USB connector 9*b* is deferred.

As illustrated in FIG. 15, a recessed guide 2*b* is provided in a front side area on the left side face 31 of the main body 30 of the handheld printer 1*b*. The recessed guide 2*b* serves as a guidance for finger placement when a user holds the handheld printer 1*b*. For example, the user places a right thumb in the recessed guide 2*b* when holding the handheld printer 1*b* with the right hand. Note that, in the present embodiment, the recessed guide 2*b* is provided as a guidance for finger placement. Alternatively, a plurality of bulges may be provided as a guide or guidance to indicate where to place a finger.

Note that, similar to the handheld printer 1 described above with reference to FIG. 1A, the main body 30 of the handheld printer 1*b* may further include at least one of, e.g., the guide rollers 4 and the LED 8. As described above, the guide rollers 4 assist the movement of the main body 30 in the lateral direction (i.e., scanning direction). The LED 8 displays the operation status of the handheld printer 1*b*.

Figure 16:
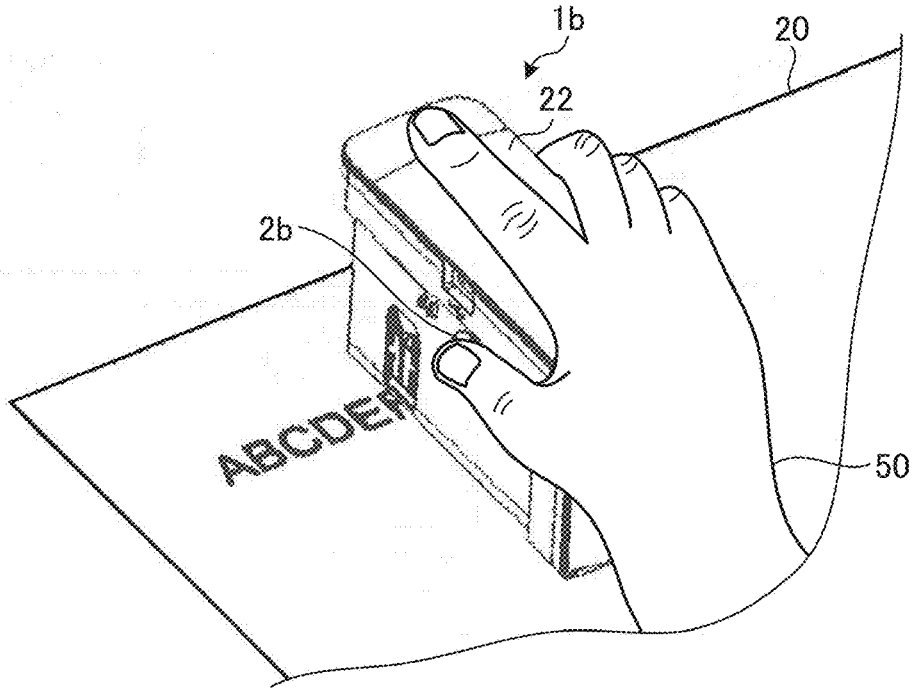
FIG. 16 is an external perspective view of the handheld printer held according to the third embodiment.

Referring now to FIG. 16, a description is given of relative positions of the USB connector 9*b* and the user's hand 50 holding the handheld printer 1*b*.

FIG. 16 is an external perspective view of the handheld printer 1*b* held according to the third embodiment.

FIG. 16 illustrates the handheld printer 1*b* held by the user's hand 50. The handheld printer 1*b* is provided with the USB connector 9*b* on the main body 30. As illustrated in FIG. 16, the user's hand 50 (particularly, index finger) covers the upper face 22 of the handheld printer 1*b*. When the USB connector 9*b* is disposed on the upper face 22 of the handheld printer 1*b*, the USB cable 151 connected to the USB connector 9*b* may interfere with the user's hand 50 holding the handheld printer 1*b*. Such an interference may disturb the user to hold the handheld printer 1*b*, causing difficulties in print scanning.

To address such a situation, the USB connector 9*b* is disposed on the left side face 31 of the handheld printer 1*b*. Specifically, as illustrated in FIG. 16, the right thumb of the user's hand 50 is placed in the recessed guide 2*b* provided on the main body 30.

Accordingly, an area not covered by the user's hand 50 is secured in the area close to the upper face 22 on the left side face 31 of the main body 30. The USB connector 9*b* is disposed in the area thus secured. In the example illustrated in FIG. 16, the USB connector 9*b* is disposed substantially at the center portion, in the longitudinal (i.e., front-to-back) direction of the handheld printer 1*b*, in the area close to the upper face 22 on the left side face 31 of the main body 30. Since the user's hand 50 is not placed on the USB connector 9*b* disposed in the area secured. The USB cable 151 connected to the USB connector 9*b* does not interfere with the user's hand 50. Accordingly, the operability is maintained without difficulties in the scanning operation at the time of printing. In addition, the area secured is distanced from the print medium 20. The USB cable 151 connected to the USB connector 9*b* disposed in the area secured rarely contacts a printed image on the print medium 20. That is, the USB cable 151 rarely stretches or rubs ink of the printed image, thereby preventing the image deterioration.

Note that, in the example illustrated in FIG. 16, the USB connector 9*b* is disposed substantially at the center portion, in the longitudinal (i.e., front-to-back) direction of the handheld printer 1*b*, in the area close to the upper face 22 on the left side face 31 of the main body 30. However, the location of the USB connector 9*b* is not limited to the location illustrated in FIG. 16. That is, the USB connector 9*b* is locatable in an unobstructed area, which does not disturb the user to hold the handheld printer 1*b*, in the area close to the upper face 22 on at least one of the left side face 31, the right side face 32, the back side face 41, and the front side face 51. For example, when the recessed guide 2*b* is provided as illustrated in FIG. 16, the USB connector 9*b* is locatable in a back side area in the area close to the upper face 22 on the left side face 31, or in the area close to the upper face 22 on the back side face 41, instead of or in addition to the area in which the USB connector 9*b* is located in FIG. 16. By contrast, when the USB connector 9*b* is disposed in the area close to the upper face 22 on the front side face 51, the USB cable 151 connected to the USB connector 9*b* may interfere with the user's hand 50 holding the handheld printer 1*b* as analogized from FIG. 16. Such an interference may disturb the user to hold the handheld printer 1*b*, causing difficulties in print scanning.

Another guide may be provided on the right side face 32 of the handheld printer 1*b*, as a second guide for placement of fingers other than the thumb of the user's hand 50 (e.g., middle finger, ring finger, little finger). In this case, the USB connector 9*b* may be disposed in an area other than the second guide (i.e., area in which the second guide is not provided) in the area close to the upper face 22 on the right side face 32. Since the user's hand 50 is not placed in the area. The USB cable 151 connected to the USB connector 9*b* disposed in the area does not interfere with the user's hand 50. Accordingly, the operability is maintained without difficulties in the scanning operation at the time of printing.

Figure 17A:
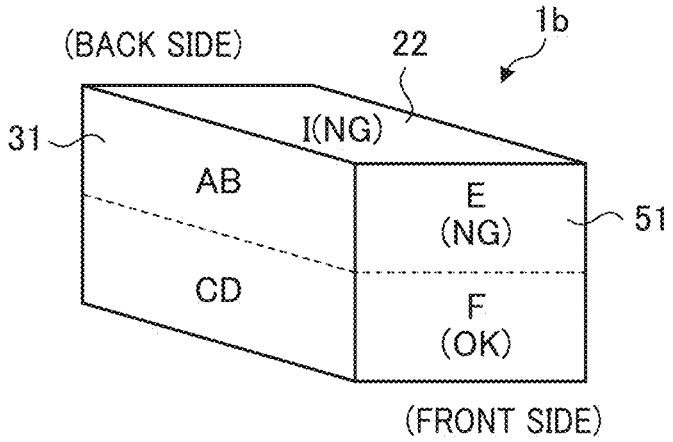
FIG. 17A is a diagram illustrating some possible locations of a USB connector in the handheld printer according to the third embodiment.
Figure 17B:
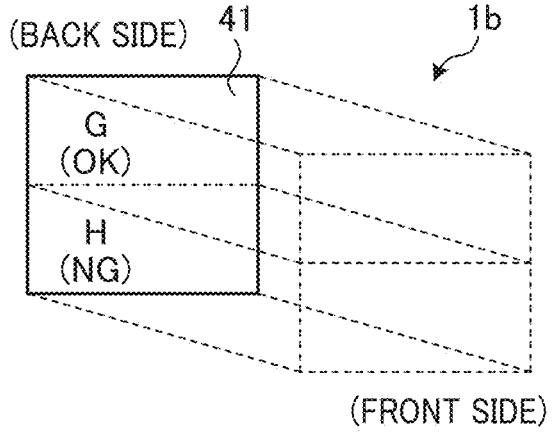
FIG. 17B is another diagram illustrating some other possible locations of the USB connector in the handheld printer according to the third embodiment.
Figure 17C:
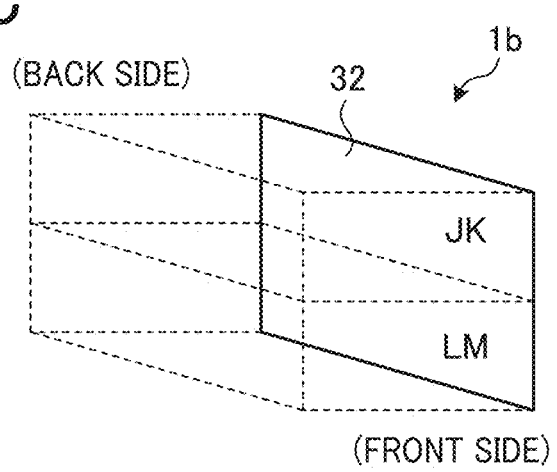
FIG. 17C is yet another diagram illustrating residual possible locations of the USB connector in the handheld printer according to the third embodiment.

In light of the consideration as described above with reference to FIG. 16, a description is now given of possible locations of the USB connector 9*b* in the handheld printer 1*b* according to the third embodiment with reference to FIGS. 17A to 17C.

FIG. 17A is a diagram illustrating some possible locations of the USB connector 9*b* in the handheld printer according to the third embodiment. FIG. 17B is another diagram illustrating some other possible locations of the USB connector 9*b* in the handheld printer according to the third embodiment. FIG. 17C is yet another diagram illustrating residual possible locations of the USB connector 9*b* in the handheld printer according to the third embodiment.

As illustrated in FIG. 17A, the left side face 31 of the handheld printer 1*b* is divided into two areas AB and CD. The area AB is an upper area (i.e., area close to the upper face 22; whereas the area CD is a lower area (i.e., area close to the lower face 11). The upper face 22 of the handheld printer 1*b* is defined as an area I. The front side face 51 of the handheld printer 1 is divided into two areas E and F. The area E is an upper area; whereas the area F is a lower area (i.e., area closer to the lower face 11 than the upper face 22).

The area AB, as an area close to the upper face 22 on the left side face 31, includes the unobstructed area as described above with reference to FIG. 16. The unobstructed area is not covered by the user's hand 50. The USB cable 151 connected to the USB connector 9*b* disposed in the unobstructed area rarely contacts a printed image. For example, when the recessed guide 2*b* is provided as illustrated in FIG. 16, the USB connector 9*b* is locatable in the back side area in the area close to the upper face 22 on the left side face 31, or in the area close to the upper face 22 on the back side face 41, instead of or in addition to the area in which the USB connector 9*b* is located in the area AB. Such a location of the USB connector 9*b* maintains the operability without difficulties in the scanning operation at the time of printing. The USB cable 151 apart from the printed image rarely stretches or rubs ink of the printed image, thereby preventing the image degradation. Accordingly, the unobstructed area in the area AB is suitable as a location of the USB connector 9*b*.

The area CD is substantially the same as the areas C and D described above in the first and second embodiments.

When the USB connector 9*b* is disposed in the area E, the USB cable 151 connected to the USB connector 9*b* may interfere with the user's hand 50 holding the handheld printer 1*b* as analogized from FIG. 16. Such an interference may disturb the user to hold the handheld printer 1*b*, causing difficulties in print scanning. Accordingly, the area E is unsuitable as a location of the USB connector 9*b*.

The areas F and I are as described above in the first and second embodiments. Referring now to FIG. 17B, a description is given of some other possible locations of the USB connector 9*b*.

As illustrated in FIG. 17B, the back side face 41 of the handheld printer 1*b* is divided into two areas G and H. The area G is an upper area (i.e., area closer to the upper face 22 than the lower face 11); whereas the area H is a lower area.

The area G is an area in which the user's hand 50 is not placed. In addition, the USB cable 151 connected to the USB connector 9*b* disposed in the area G rarely contacts a printed image. Accordingly, the operability is maintained without difficulties in the scanning operation at the time of printing. The USB cable 151 apart from the printed image rarely stretches or rubs ink of the printed image, thereby preventing the image degradation. Accordingly, the area G is suitable as a location of the USB connector 9*b*.

The area H is as described above in the first and second embodiments.

Referring now to FIG. 17C, a description is given of residual possible locations of the USB connector 9*b*.

As illustrated in FIG. 17C, the right side face 32 of the handheld printer 1*b* is divided into two areas JK and LM. The area JK is an upper area (i.e., area close to the upper face 22); whereas the area LM is a lower area (i.e., area close to the lower face 11).

The area JK, as an area close to the upper face 22 on the right side face 32, includes the unobstructed area as described above with reference to FIG. 16. The unobstructed area is not covered by the user's hand 50. The USB cable 151 connected to the USB connector 9*b* disposed in the unobstructed area rarely contacts a printed image. When the second guide is provided on the right side face 32 for placement of fingers other than the thumb of the user's hand 50 (e.g., middle finger, ring finger, little finger) as described above, for example, the USB connector 9*b* is locatable in the area other than the second guide in the area JK. Such a location of the USB connector 9*b* maintains the operability without difficulties in the scanning operation at the time of printing. The USB cable 151 apart from the printed image rarely stretches or rubs ink of the printed image, thereby preventing the image degradation. Accordingly, the unobstructed area in the area JK is suitable as a location of the USB connector 9*b*.

The area LM is substantially the same as the areas L and M described above in the first and second embodiments.

As described above, in the handheld printer 1*b* according to the present embodiment, the USB connector 9*b* is located in the unobstructed area in the area close to the upper face 22 on at least one of the left side face 31, the right side face 32, the back side face 41, and the front side face 51. For example, when the recessed guide 2*b* is provided in the front side area on the left side face 31 of the main body 30 of the handheld printer 1*b*, an area not covered by the user's hand 50 is secured in the area AB. The USB connector 9*b* is providable in the area thus secured. Since the user's hand 50 is not placed in the area G (i.e., upper area on the back side face 41), the USB connector 9*b* is providable in the area G. When the second guide is provided on the right side face 32 of the main body 30 for placement of fingers other than the thumb of the user's hand 50 (e.g., middle finger, ring finger, little finger), for example, the USB connector 9*b* is providable in the area other than the second guide in the area JK. Thus, when the handheld printer 1*b* is held and moved for scanning as a print operation with the USB cable 151 connected to the USB connector 9*b* located in a suitable area, the USB cable 151 does not disturb the print operation or contact a printed image. That is, the USB cable 151 apart from the printed image prevents deterioration of the printed image. Note that the location of the USB connector 9*b* is not limited to one location. Alternatively, a plurality of USB connectors 9*b* may be located in the above-described possible (or suitable) locations.

Note that in the embodiments described above, when at least one of the functional units of the handheld printers 1, 1*a*, and 1*b* is implemented by execution of a program, the program is incorporated in advance in a read only memory (ROM) or the like, thus being provided. The program executed in the handheld printers 1, 1*a*, and 1*b* according to the embodiments described above may be recorded on or stored in a computer-readable recording or storage medium such as a compact disc read-only memory (CD-ROM), a flexible disk (FD), a compact disc recordable (CD-R), or a digital versatile disk (DVD), in a file in installable or executable format, thus being providable. Alternatively, the program executed in the handheld printers 1, 1*a*, and 1*b* according to the embodiments described above may be stored in a computer connected to a network such as the Internet and downloaded via the network, thus being providable. Alternatively, the program executed in the handheld printers 1, 1*a*, and 1*b* according to the embodiments described above may be provided or distributed via a network such as the Internet. The program executed in the handheld printers 1, 1*a*, and 1*b* according to the embodiments described above has a module configuration including at least one of the functional units described above. As an actual hardware configuration, the CPU of the controller 101 reads the program from the storage device (e.g., memory 102) described above and executes the program, thereby loading and generating the functional units described above on a main memory.

According to the embodiments described above, a handheld printer prevents degradation of a printed image while a cable connected to the handheld printer does not disturb the operation of the handheld printer.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

Any one of the above-described operations may be performed in various other ways, for example, in an order different from that described above.

Any of the above-described devices or units can be implemented as a hardware apparatus, such as a special-purpose circuit or device, or as a hardware/software combination, such as a processor executing a software program.

Further, each of the functions of the described embodiments may be implemented by one or more processing circuits or circuitry. Processing circuitry includes a programmed processor, as a processor includes circuitry. A processing circuit also includes devices such as an application-specific integrated circuit (ASIC), digital signal processor (DSP), field programmable gate array (FPGA) and conventional circuit components arranged to perform the recited functions.

Further, as described above, any one of the above-described and other methods of the present disclosure may be embodied in the form of a computer program stored on any kind of storage medium. Examples of storage media include, but are not limited to, floppy disks, hard disks, optical discs, magneto-optical discs, magnetic tapes, nonvolatile memory cards, read only memories (ROMs), etc.

Alternatively, any one of the above-described and other methods of the present disclosure may be implemented by the ASIC, prepared by interconnecting an appropriate network of conventional component circuits or by a combination thereof with one or more conventional general-purpose microprocessors and/or signal processors programmed accordingly.

What is claimed is:

1. A handheld recording device comprising:
a first face having an opening;
a second face opposite the first face;
a third face on one side of the second face in a given direction of the second face and configured to be held by a user for recording;
a fourth face opposite the third face;
a recorder configured to discharge ink from the opening; and
a connector configured to be connected to a cable to receive at least one of power or image data,
the connector being on the fourth face at a position closer to the second face than the first face.

2. The handheld recording device according to claim 1,
wherein the connector has a longitudinal shape in a direction perpendicular to the first face.

3. The handheld recording device according to claim 1, further comprising a plurality of connectors including the connector.

4. The handheld recording device according to claim 1, further comprising:
a fifth face on another side of the second face in a direction perpendicular to the given direction; and
a sixth face opposite the fifth face, wherein
the recorder is at a position closer to the fifth face than the sixth face, and
the connector is at a position closer to the sixth face than the fifth face.

5. The handheld recording device according to claim 1, wherein
the second face is longer in a first direction than a second direction, and
the third face extends in the first direction.

6. The handheld recording device according to claim 1, wherein
the second face is longer in a first direction than a second direction, and
the third face extends in the second direction.

7. A handheld recording device comprising:
a first face having an opening;
a second face opposite the first face;
a third face and a fourth face different from the first face and the second face, the fourth face opposite the third face,
wherein the third face and the fourth face are configured to be held by a user for recording;
a recorder configured to discharge ink from the opening;
a connector configured to be connected to a cable to receive at least one of power or image data; and
a guide disposed on at least one of the third face or the fourth face for finger placement,
the connector on at least one of the third face or the fourth face at a position closer to the second face in an area other than the guide.

8. The handheld recording device according to claim 7,
wherein the guide is disposed in a direction perpendicular to a given direction of the second face on the third face.

9. The handheld recording device according to claim 7, further comprising:
a fifth face perpendicular to the third face; and
a sixth face opposite the fifth face, wherein
the recorder is at a position closer to the fifth face than the sixth face, and
the connector is at a position closer to the sixth face than the fifth face.

10. The handheld recording device according to claim 7, wherein
the second face is longer in a first direction than a second direction, and
the third face extends in the first direction.

11. The handheld recording device according to claim 7, wherein
the second face is longer in a first direction than a second direction, and
the third face extends in the second direction.

12. A handheld recording device comprising:
a first face having an opening on one side in a given direction of the first face;
a second face opposite the first face;
a third face different from the first face and the second face,
the third face being disposed on another side in the given direction of the first face;
a recorder configured to discharge ink from the opening; and
a connector configured to be connected to a cable to receive at least one of power or image data,
the connector disposed at a position closer to the first face than the second face on the third face.

* * * * *